US010980354B2

(12) United States Patent
Ross et al.

(10) Patent No.: US 10,980,354 B2
(45) Date of Patent: Apr. 20, 2021

(54) TEXTILE DECK ASSEMBLY FOR FURNITURE ITEMS

(71) Applicant: ASHLEY FURNITURE INDUSTRIES, INC., Arcadia, WI (US)

(72) Inventors: Thad D. Ross, Thaxton, MS (US); Gary L. Messer, Myrtle, MS (US); Nathaniel B. Robbins, Tupelo, MS (US)

(73) Assignee: Ashley Furniture Industries, Inc., Arcadia, WI (US)

( * ) Notice: Subject to any disclaimer, the term of this patent is extended or adjusted under 35 U.S.C. 154(b) by 0 days.

(21) Appl. No.: 16/345,222

(22) PCT Filed: Oct. 26, 2017

(86) PCT No.: PCT/US2017/058606
§ 371 (c)(1),
(2) Date: Apr. 25, 2019

(87) PCT Pub. No.: WO2018/081471
PCT Pub. Date: May 3, 2018

(65) Prior Publication Data

US 2019/0290017 A1 Sep. 26, 2019

Related U.S. Application Data

(60) Provisional application No. 62/564,424, filed on Sep. 28, 2017, provisional application No. 62/543,148,
(Continued)

(51) Int. Cl.
*A47C 17/02* (2006.01)
*A47C 31/02* (2006.01)
(Continued)

(52) U.S. Cl.
CPC ..... *A47C 31/023* (2013.01); *A47C 7/32* (2013.01); *A47C 17/02* (2013.01); *A47C 17/86* (2013.01);
(Continued)

(58) Field of Classification Search
CPC ..... A47C 31/023; A47C 31/04; A47C 31/02; A47C 7/22; A47C 7/32; A47C 17/02;
(Continued)

(56) References Cited

U.S. PATENT DOCUMENTS 1,554,902 A 9/1925 Balikjian
1,622,188 A * 3/1927 Edwards ..... A47C 17/66 5/114
(Continued)

FOREIGN PATENT DOCUMENTS

GB 592130 A 9/1947
WO WO-2019199216 A1 * 10/2019 ..... A47C 5/06

*Primary Examiner* — Syed A Islam
(74) *Attorney, Agent, or Firm* — Christensen, Fonder, Dardi & Herbert PLLC

(57) ABSTRACT

A textile deck assembly, method of fabricating, and method of installing onto a seat frame assembly. The textile deck assembly includes a platform portion and a plurality of straps coupled to a rearward edge of the platform portion. The materials of the textile deck assembly are matched so that the plurality of straps undergoes most or all of the elongation under load (e.g., when a person sits thereon), while the platform portion, even though it is flexible and compliant, is stretch resistant and undergoes little or no stretching under load. A battery of durability tests were performed on the textile deck assembly, including deflection testing, fatigue testing, and drop testing, and compared with conventional seat decks that utilize sinuous springs. The durability of the textile deck assembly to was found to outperform conventional seat decks.

20 Claims, 18 Drawing Sheets

Related U.S. Application Data filed on Aug. 9, 2017, provisional application No. 62/413,141, filed on Oct. 26, 2016.

(51) Int. Cl.

| | |
|---|---|
| ***A47C 17/86*** | (2006.01) |
| ***A47C 23/24*** | (2006.01) |
| ***A47C 31/04*** | (2006.01) |
| ***A47C 23/26*** | (2006.01) |
| ***A47C 23/18*** | (2006.01) |
| ***A47C 7/32*** | (2006.01) |
| *A47C 7/22* | (2006.01) |
| *A47C 4/30* | (2006.01) |

(52) U.S. Cl.

CPC ..... *A47C 23/18* (2013.01); *A47C 23/24* (2013.01); *A47C 23/26* (2013.01); *A47C 31/04* (2013.01); *A47C 4/30* (2013.01); *A47C 7/22* (2013.01)

(58) Field of Classification Search

CPC ..... A47C 17/86; A47C 23/24; A47C 23/26; A47C 23/18; A47C 4/06; A47C 4/30; A47C 5/06

See application file for complete search history.

(56) References Cited

U.S. PATENT DOCUMENTS

| | | | | | |
|---|---|---|---|---|---|
| 1,716,176 | A | | 6/1929 | Vitez-Keresztfalvy | |
| 3,037,766 | A | | 6/1962 | Berg | |
| 3,057,613 | A | * | 10/1962 | Benjamin | A47C 23/24 267/103 |
| 3,068,493 | A | * | 12/1962 | Farstrup | A47C 23/24 5/191 |
| 3,081,077 | A | | 3/1963 | Sudman | |
| 3,115,093 | A | | 12/1963 | Andrus | |
| 3,179,469 | A | | 4/1965 | Heuston | |
| 3,333,841 | A | | 8/1967 | Damiano | |
| 3,375,861 | A | | 4/1968 | Marlow | |
| 3,497,883 | A | * | 3/1970 | Arnold | A47C 7/32 5/188 |
| 3,498,598 | A | | 3/1970 | Rathbun | |
| 3,502,316 | A | | 3/1970 | Saether | |
| 3,667,749 | A | * | 6/1972 | Platt et al. | A47C 7/32 267/112 |
| 3,695,706 | A | * | 10/1972 | Basher | A47C 7/22 297/452.56 |
| 3,700,282 | A | | 10/1972 | Rowland | |
| 3,902,756 | A | * | 9/1975 | Chubb | A47C 7/22 297/452.56 |
| 3,913,978 | A | * | 10/1975 | Lester | A47C 7/16 297/448.2 |
| 4,285,080 | A | * | 8/1981 | Kitchen | A47C 23/20 428/192 |
| 4,842,257 | A | * | 6/1989 | Abu-Isa | B60N 2/7011 264/176.1 |
| 4,928,334 | A | * | 5/1990 | Kita | B29C 53/36 5/191 |
| 5,288,136 | A | | 2/1994 | Webber et al. | |
| 5,544,943 | A | | 8/1996 | Durling | |
| 5,700,060 | A | | 12/1997 | Bullard et al. | |
| 6,039,404 | A | | 3/2000 | Fontana | |
| 6,116,694 | A | * | 9/2000 | Bullard | A47C 7/287 267/87 |
| 6,234,578 | B1 | | 5/2001 | Barton et al. | |
| 6,241,317 | B1 | | 6/2001 | Wu | |
| 6,644,752 | B2 | | 11/2003 | Takata | |
| D524,565 | S | | 7/2006 | Franks | |
| 7,594,701 | B2 | * | 9/2009 | Kawabata | B64D 11/0639 297/452.63 |
| 7,618,572 | B2 | | 11/2009 | Coffield | |
| 8,136,884 | B2 | | 3/2012 | Bullard et al. | |
| 8,465,007 | B2 | | 6/2013 | Coffield et al. | |
| 8,550,565 | B2 | | 10/2013 | Caldwell | |
| 9,004,604 | B2 | * | 4/2015 | Bogard | A47C 7/28 160/378 |
| 9,078,524 | B2 | * | 7/2015 | Bullard | A47C 3/00 |
| 9,247,820 | B2 | | 2/2016 | Bullard | |
| 10,111,528 | B1 | * | 10/2018 | Mabon | A47C 7/282 |
| 2003/0001424 | A1 | | 1/2003 | Mundell et al. | |
| 2011/0035875 | A1 | | 2/2011 | Brandtner | |
| 2012/0204392 | A1 | | 8/2012 | Luangphon | |
| 2014/0375103 | A1 | | 12/2014 | Lejcher et al. | |

* cited by examiner

TEXTILE DECK ASSEMBLY FOR FURNITURE ITEMS

RELATED APPLICATIONS

The present application is a National Phase entry of PCT Application No. PCT/US2017/058606, filed Oct. 26, 2017, which claims the benefit of U.S. Provisional Patent Application No. 62/413,141, filed Oct. 26, 2016, U.S. Provisional Patent Application No. 62/543,148, filed Aug. 9, 2017, and U.S. Provisional Patent Application No. 62/564,424, filed Sep. 28, 2017, the disclosures of which are hereby incorporated by reference in their entirety.

FIELD OF THE DISCLOSURE

The present disclosure is directed to seat decks for furniture items. More specifically, the present disclosure is directed to a seat deck fabricated primarily from textile materials.

BACKGROUND OF THE DISCLOSURE

Conventional seat boxes for sofas and love seats include a framework that is spanned by a plurality of sinuous-shaped springs. The sinuous springs are typically pre-bowed along their axes, and mounted to the seat box so as to form a "crown" (i.e., a are bowed or convex in an upward direction relative to the seat box). Each sinuous spring is mounted to the seat box with special clips, one disposed at each end of each sinuous spring. The clips are aligned and mounted on opposing forward and rearward structures on the seat box, and the sinuous spring stretched between and joined to the clips. To accomplish the stretching operation, typical tension forces of nominally 65 pounds-force (lbf) are required. Only after installation of the sinuous springs may a textile overlay be mounted over the sinuous springs.

Assembly of conventional seat boxes described above thus requires fabrication of the specialized clips and the pre-bowed sinuous springs, both of which are typically fabricated from metal. Alignment of the clips and the mounting and stretching of the sinuous springs requires time and careful attention, in addition to the time and attention required to install the textile overlay. The task of mounting and stretching the sinuous springs is a perilous task, with resulting injuries to assemblers being a leading cause of workman compensation claims in the furniture industry. Furthermore, because the cushions are supported by the sinuous springs, the sinuous springs cannot be spaced too far apart. Center-to-center spacing of sinuous springs that is nominally 3.5 inches is typical in the industry, thus imparting a distributed load on the furniture frame that exceeds 18 pounds per lineal inch.

Moreover, the sinuous springs often fail a "drop test" where a 200 pound weight is dropped onto the seat box a total of 10 times, each time from a height of six inches. The drop test is intended to simulate conditions that furniture items often incur after purchase. During such drop testing, some of the sinuous springs are often dislodged from the clips, demonstrating that the conventional seat box does not hold up under the rigors of use.

A seat frame assembly that reduces the parts required for installation, simplifies the installation process, and performs better under drop test conditions would be welcomed.

SUMMARY OF THE DISCLOSURE

Various embodiments of the disclosure include a textile deck assembly installed in or for installation in a furniture assembly. The textile deck assembly includes a platform portion partially suspended by straps disposed under the backrest of the furniture item. In one embodiment, the platform portion, while flexible, is stretch resistant, while the straps are configured to elongate under load to provide a comfortable degree of compliance. Surprisingly, the textile deck assembly is much more durable than conventional seat decks that utilize sinuous springs. Various tests on the disclosed furniture assembly reveal that, even after catastrophic failure of the structural elements of the seat box, the textile deck assembly of the present disclosure remained intact and operable, and under conditions where the seat deck of the counterpart conventional sofa would experience 100% failure. Endurance testing also revealed that, after being subjected to the rigors of standardized fatigue and drop testing, the permanent sag of the disclosed textile deck assembly was less than ¼ than that of the conventional sofa, and the downward deflection of the disclosed textile deck assembly under load was less than ⅓ than that of the conventional sofa.

The forces required for installing the disclosed seat deck assemblies in a furniture assembly is also substantially reduced over that of conventional sinuous spring assemblies. First, the disclosed seat deck assemblies provide continuous support across the lower face of the seat cushions, as opposed to support provided primarily by sinuous springs that span under the cushions. This enables fewer spring members to be utilized to fully support the seat cushions. Second, because the spring members of the disclosed embodiments are a fraction of the length of the sinuous springs of conventional furniture assemblies and are not required to support the seat cushions, they do not have to be drawn as tautly as the sinuous springs in conventional furniture assemblies. That is, because the vertical deflection over the shorter length of the disclosed spring members does not adversely affect the support of the seat cushions, the installation forces required is reduced. In the disclosed embodiments, the force required per spring member is typically less than 80% of the force required for installation of sinuous springs, and the number of spring members is typically less than half the number of sinuous springs required in conventional furniture assemblies. Also, the counter forces required of the seat frame in the disclosed embodiments is in the range of 20% to 50% of conventional seat assemblies, thus reducing distortion and material requirements.

Structurally, in various embodiments of the disclosure, a furniture assembly comprises a furniture frame with a forward frame member configured as a forward rail, a rearward frame member configured as a rearward rail, a pair of side frame members and a deck assembly. The deck assembly may include a flexible sheet platform portion including a forward edge and a rearward edge, an edge stiffener configured as a yoke member disposed proximate the rearward edge of the flexible sheet platform portion, and a plurality of spring members coupled to the yoke member, the plurality of spring members extending rearward of the rearward edge of the flexible sheet platform portion. The flexible sheet platform portion may be a textile platform portion. In embodiments the rectangular platform maybe woven with thread, rope, or straps. There may be apertures in the woven platform. The forward edge of the flexible sheet platform portion is directly attached to the forward rail, and the rearward edge of the flexible sheet platform portion is coupled to the rearward rail via the yoke member and the plurality of spring members, the plurality of spring members extending rearward of the rearward edge.

The yoke member acts to distribute tension loads imparted by the plurality of spring members along the rearward edge of the flexible sheet platform portion. The yoke member may be one of a rod, a bar, and a tubing. Optionally, the yoke member may be one of a rope and a strap affixed directly to the rearward edge of the flexible sheet platform portion. In some embodiments, the forward edge of the flexible sheet platform portion is directly attached to the forward rail with a plurality of fasteners that are spaced less than one inch apart along the forward edge. The plurality of spring members are spaced apart along the rearward edge to define a center-to-center spacing between adjacent ones of the plurality of spring members. In some embodiments, the center-to-center spacing may be in a range of 4 inches to 12 inches inclusive. The plurality of spring members may be selected from the group consisting of elastic straps, elastic cords, and coil springs. In some embodiments, a seat frame assembly includes a front wall and two opposed side walls, the forward rail being affixed to the front wall. The flexible sheet platform portion may include opposing side edges that extend between the forward edge and the rearward edge, each of the opposing side edges being directly attached to a respective one of the two opposed side frame members such as walls of the frame assembly.

In various embodiments of the disclosure, a textile deck assembly for a furniture item comprises a textile platform portion including a forward edge, a rearward edge, and opposed side edges; at least one yoke member disposed proximate the rearward edge of the textile platform portion; and a plurality of straps coupled to the at least one yoke member, the plurality of straps extending rearward of the rearward edge of the textile platform portion. The plurality of straps are configured for greater elongation in a fore and aft direction than the textile platform portion when the textile deck assembly is placed under a tension load in the fore and aft direction. The textile platform portion may include a plurality of platform loops that define the rearward edge of the textile platform portion, and wherein the at least one yoke member is captured within the plurality of platform loops.

In some embodiments, the at least one yoke member is a plurality of yoke members that extend end to end along a yoke axis through the platform loops, and wherein adjacent ends of the plurality of yoke members are disposed within the platform loops. The plurality of yoke members may be rigid. In some embodiments, at least one guide strip is disposed at and defines the forward edge of the textile platform portion. The at least one guide strip may be a plurality of guide strips that extend end to end, and wherein each of the plurality of guide strips are approximately the same length as a corresponding one of the plurality of yoke members, so that fold axes are defined that pass between adjacent ends of the plurality of guide strips and between the adjacent ends of the plurality of yoke members, the fold axes being substantially perpendicular to the yoke axis.

In some embodiments, the textile deck assembly is folded along the fold axes. For some embodiments, when the textile deck assembly is subject to an increased tension load in the fore and aft direction, the plurality of straps elongates more than the textile platform portion in the fore and aft direction. In various embodiments, when the textile deck assembly is subject to the increased tension load in the fore and aft direction, the plurality of straps elongate an average first dimension in the fore and aft direction and the textile platform portion elongates an average second dimension in the fore and aft direction, wherein a ratio of the average second dimension to the average first dimension is less than 1:4. In some embodiments, the ratio of the average second dimension to the average first dimension is less than 1:8. In some embodiments, the ratio of the average second dimension to the average first dimension is less than 1:16. In some embodiments, the ratio of the average second dimension to the average first dimension is less than 1:32.

In some embodiments, the textile deck assembly comprises a plurality of strap clips, each coupled to a respective one of the plurality straps, for affixing the plurality of straps to a rearward rail to maintain the textile deck assembly in tension. Each of the plurality of strap clips may include a cross portion supported by a pair of hook portions, each of the hook portions having a proximal end attached to the cross portion and a free distal end. In some embodiments, a first of the pair of hook portions and a second of the pair of hook portions defines a gap therebetween. In some embodiments, the first of the pair of hook portions and the second of the pair of hook portions are a mirrored about a central plane that is orthogonal to the cross portion.

In various embodiments of the disclosure, a method is disclosed for installing the textile deck assembly to a seat frame assembly, comprising: affixing the forward edge of the textile platform portion to a forward rail of the seat frame assembly; stretching the textile deck assembly in a rearward direction from the forward rail to place the textile deck assembly in tension; and affixing the plurality of straps to a rearward rail to maintain the textile deck assembly in tension. In some embodiments, the method includes: (a) inserting a shaft through one of the plurality of straps; (b) placing the shaft against a rearward face of the rearward rail; and (c) rotating the shaft in a rearward direction to stretch the textile deck assembly. During the step of rotating, the shaft may be brought into contact with an underside of the rearward rail.

In various embodiments of the disclosure, a method for mounting a textile seat deck to a furniture assembly is disclosed, the method comprising gripping a strap clip that is coupled to a first end of a strap, the strap having a second end that is coupled to a textile platform portion, the textile platform portion being attached to a seat frame assembly; pulling the strap clip from a first location over a rail to a second location where at least a hook portion of the strap clip is pulled past an edge of the rail, wherein pulling the strap clip from the first location to the second location increases a tension applied to the strap and the textile platform portion; aligning the hook portion of the strap clip with the rail so that releasing the pulling of the strap clip will cause the hook portion to clip on to the rail; and releasing the strap clip. The method may also include the step of securing the strap clip to the strap. In some embodiments, the strap clip is secured to the rail by the tension force applied by the strap and the platform portion. The step of gripping may include engaging a tool with the hook portion of the strap clip. The step of pulling may be performed with the tool. In some embodiments, the method includes moving the tool in a direction along the edge of the rail to remove the tool from a gap defined between the hook portion and the edge of the rail.

In embodiments the seat deck has a plurality of spaced spring members at the rearward edge for connection to a rearward frame member, no spring members at a forward edge and no spring members at a pair of side edges. A feature and advantage of embodiments is that three of four sides of a flexible rectangular platform can be attached with simple staples. A feature and advantage of embodiments is a spring loaded sofa platform that has springs on only one of four sides of a rectangular flexible platform. A feature and advantage of embodiments is that the springs at only a single edge are positioned under the backrest portion of a sofa whereby they are exposed to minimal or no direct downward loading by a person sitting on the seat of the sofa. As such the springs can be coil springs or elastic strap springs.

BRIEF DESCRIPTION OF THE DRAWINGS

FIGS. 28A-29D depict a method for coupling a seat deck with strap clips to a seat frame according to an embodiment of the disclosure;

DETAILED DESCRIPTION

Figure 1:
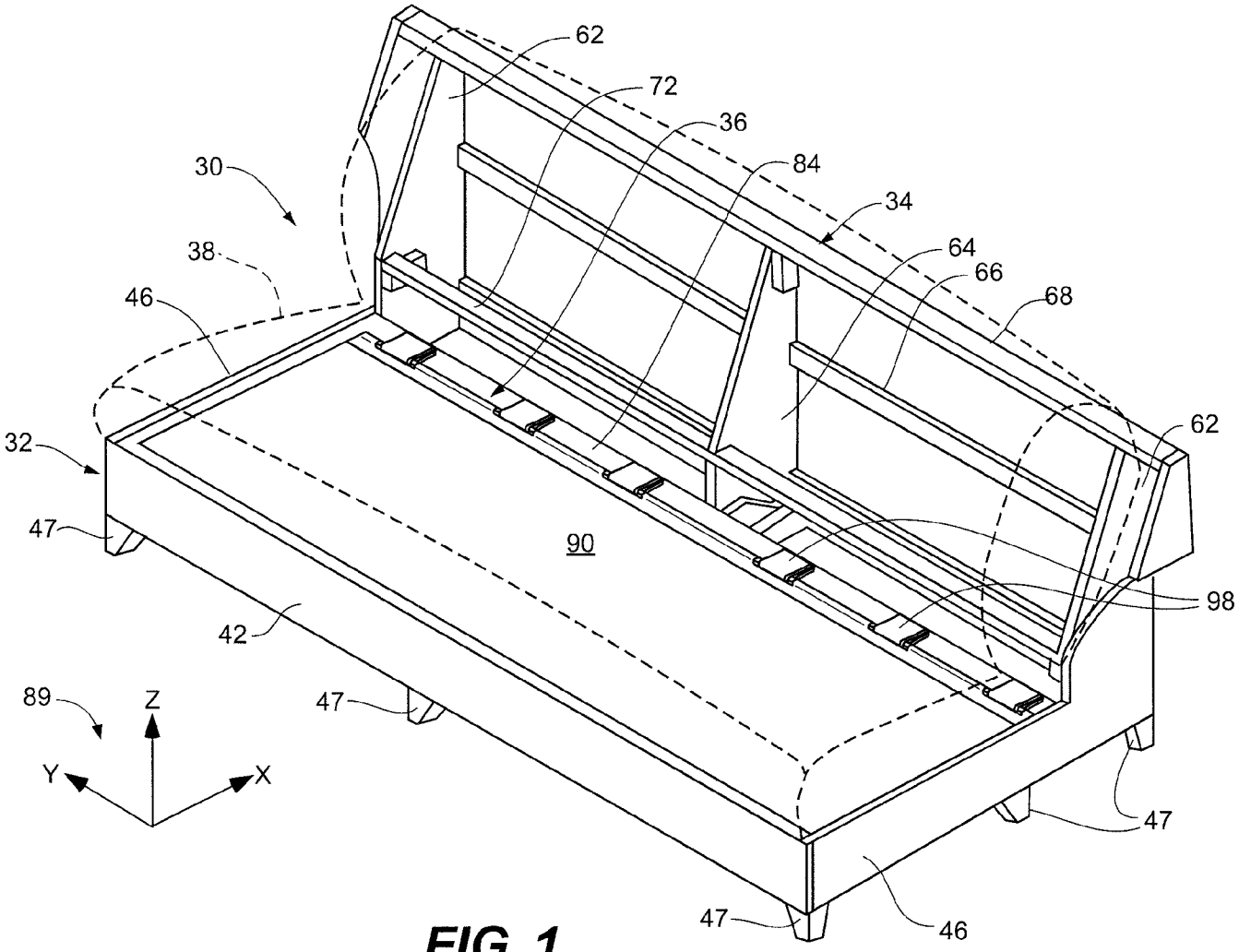
FIG. 1 is a perspective view of a furniture assembly according to an embodiment of the disclosure.
Figure 2:
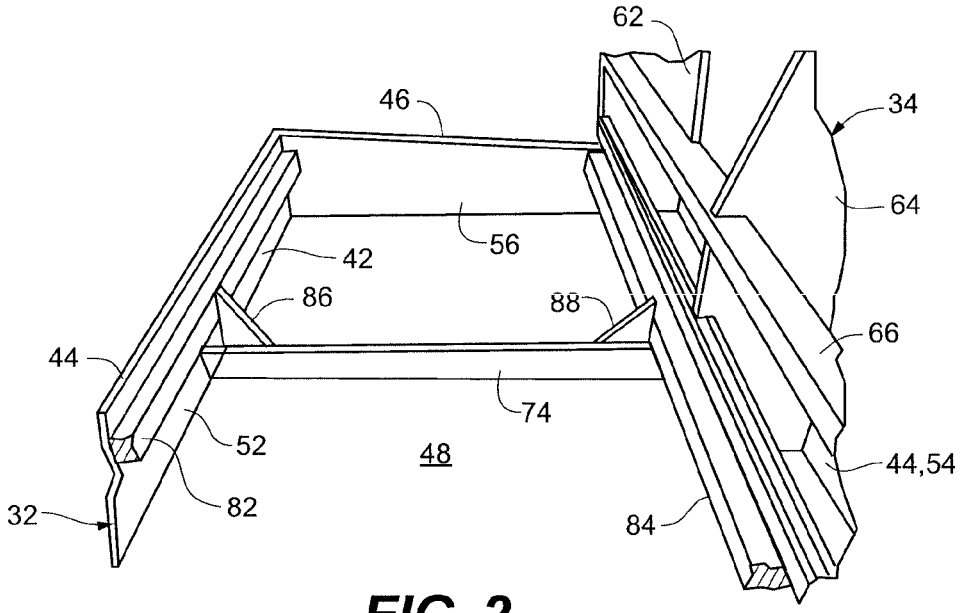
FIG. 2 is a perspective, cutaway view of a seat frame assembly with a back frame attached thereto according to an embodiment of the disclosure.
Figure 3:
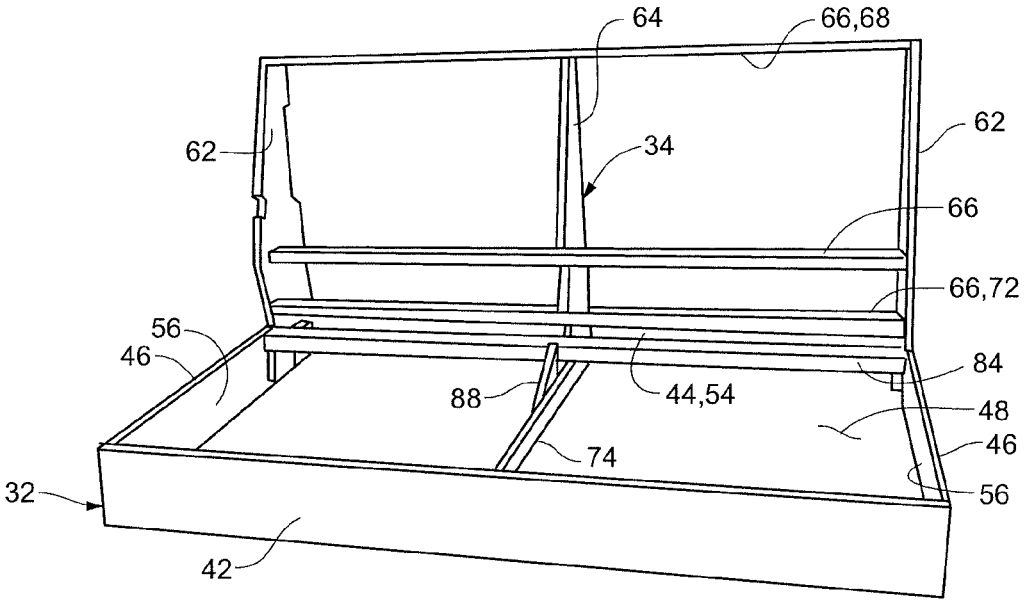
FIG. 3 is perspective view of the seat frame assembly and back frame of FIG. 2 according to an embodiment of the disclosure.

Referring to FIGS. 1, 2, and 3, a furniture assembly 30 is depicted in an embodiment of the disclosure. The furniture assembly 30 includes a seat box or seat frame assembly 32, a back frame assembly 34, a textile deck assembly 36, and at least one cushion 38. The seat frame assembly 32 comprises a front frame member configured as a front wall 42, a back frame member configured as a back wall 44, and two side wall frame members configured as side walls 46 suspended on feet 47, each of the walls 42, 44, and 46 including a respective interior face 52, 54, and 56 that surrounds and defines an interior space 48. The back frame assembly 34 includes a pair of side uprights 62 and may include one or more a mid-upright(s) 64, extending vertically from the back wall 44 of the seat frame assembly 32. The uprights 62 and 64 are tied together by backrest rails 66, including a cap rail 68 and a lower backrest rail 72. In some embodiments, the back frame assembly 34 is affixed to the back wall 44 of the seat frame assembly 32. The seat frame assembly 32 may include one or more cross-brace(s) 74 extending between the front wall 42 and the back wall 44. In the depicted embodiment, each cross-brace 74 is mounted to the front wall 42 and one of the mid-uprights 64. Alternatively or in addition, the cross-brace(s) 74 may extend to and be mounted to the back wall 44 of the seat frame assembly 32. The cross-brace(s) 74 may extend proximate the lower edges of the front and back walls 42 and 44.

The seat frame assembly 32 further includes a forward rail 82 and a rearward rail 84. In the depicted embodiment, the forward rail 82 is affixed to the interior face 52 of the front wall 42. The rearward rail 84 is suspended from the side walls 46 or the uprights 62 and 64, or from both the side walls 46 and one or more of the uprights 62 and 64. In the depicted embodiment, a forward gusset 86 is affixed to the cross-brace 74 and extends and is affixed to the front wall 42 and the forward rail 82. A rearward gusset 88 may extend between and be affixed to the cross-brace 74, the rearward rail 84, and the mid-upright 64. In some embodiments, the seat frame assembly 32 is fabricated from wood or wood products. Assemblies of varying configurations are contemplated and it is apparent that the seat frame assembly 32 of varying configurations are within the spirit and scope of this disclosure.

A Cartesian coordinate 89 is depicted in FIG. 1, having an x-axis, a y-axis, and a z-axis at an arbitrary location. Herein, "fore-and-aft" refers to a direction that is substantially parallel to the x-axis; "front", "forward" and "forwardly" refer to a direction parallel to the negative x-direction; "back", "rearward" and "rearwardly" refer to a direction parallel to the positive x-direction; "lateral" and "laterally" refer to a direction substantially parallel to the y-axis; "upward" and "upwardly" refer to a direction substantially parallel to the positive z-direction; and "downward" and "downwardly" refer to a direction substantially parallel to the negative z-direction.

Figure 1A:
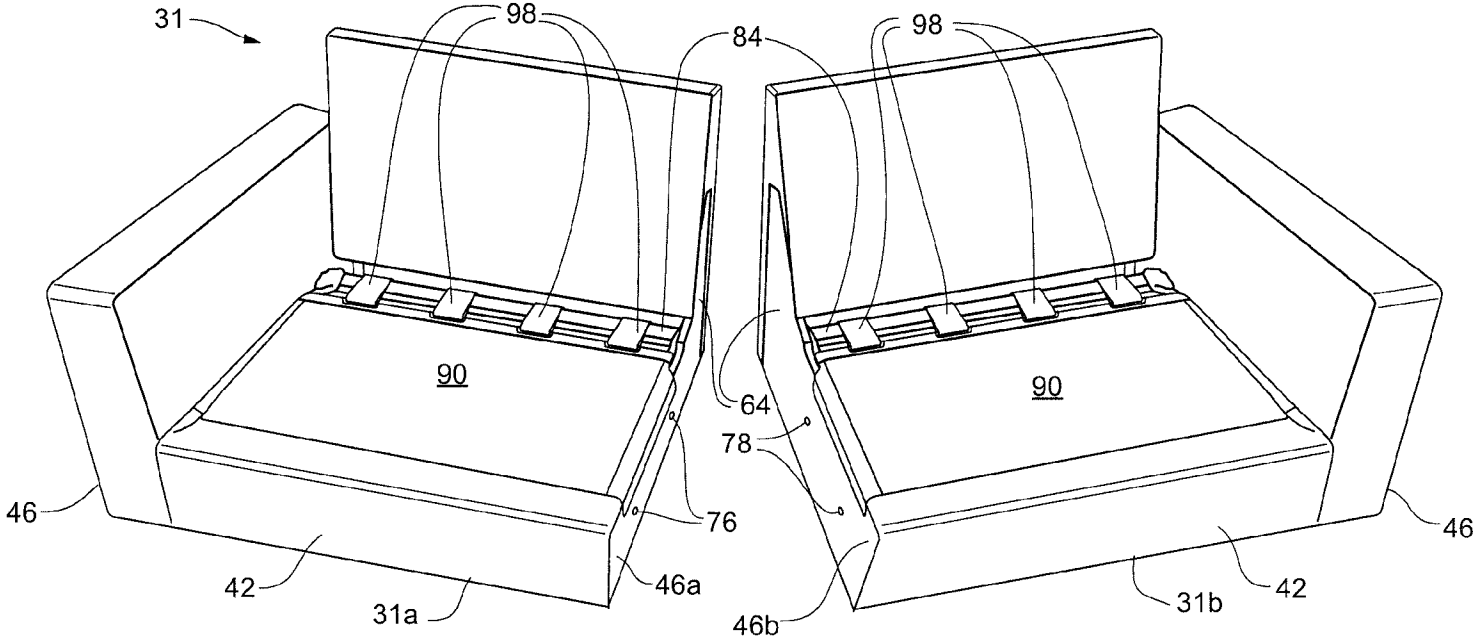
FIG. 1A is a perspective view of a two-piece "ready to assemble" furniture assembly according to an embodiment of the disclosure.

Referring to FIG. 1A, a "ready to assemble" ("RTA") furniture assembly 31 is depicted according to an embodiment of the disclosure. The RTA furniture assembly 31 includes many of the same components and attributes as the furniture assembly 30, some of which are indicated with same-numbered reference characters. The RTA furniture assembly 31 includes segments 31*a* and 31*b*, each having interior side walls 46*a* and 46*b* that are configured to abut each other upon final assembly by the consumer. The interior side walls 46*a* and 46*b* may include alignment holes 76 and threaded engagement fixtures 78 that are pre-set by the manufacturer, so that the consumer need only bolt the interior side walls 46*a* and 46*b* together for the final assembled unit.

The RTA furniture assembly 31 incorporates the same basic construction principles and implementation with respect to the textile deck assemblies 36 as described for the furniture assembly 30. In some embodiments (not depicted), the upper edges across the mid-span of the interior side walls 46*a* and 46*b* are recessed or cut away relative to the upper edges of the at the ends to enable deflection of the platform portion 90 under load. The RTA furniture assembly 31 further depicts an upholstery covering over the back frame assembly 34 and seat frame assembly 32. It is understood that such upholstery covering may be present in FIGS. 1, 2, and 3, though not depicted for purposed of clarity. In some embodiments (not depicted), the upholstery is attached to the appropriate edges of the textile deck assembly 31 for ready installation over the furniture assembly 30.

Functionally, the segmentation of the RTA furniture assembly 31 enables the RTA furniture assembly 31 to be shipped within a smaller package than would be permitted for a fully assembled furniture item such as the furniture assembly 30. See U.S. Pat. Pub. US 2017/0071354 which is incorporated herein by reference in its entirety for all purposes. The RTA furniture assembly 31 can also facilitate storage.

Figure 4:
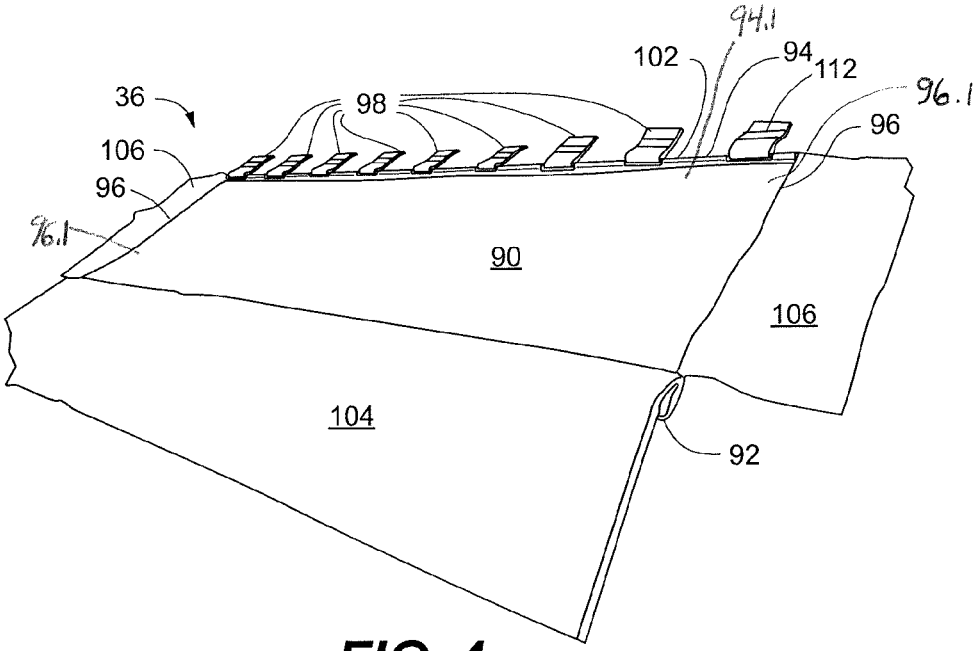
FIGS. 4 and 5 are perspective views of a textile deck assembly according to an embodiment of the disclosure.
Figure 5:
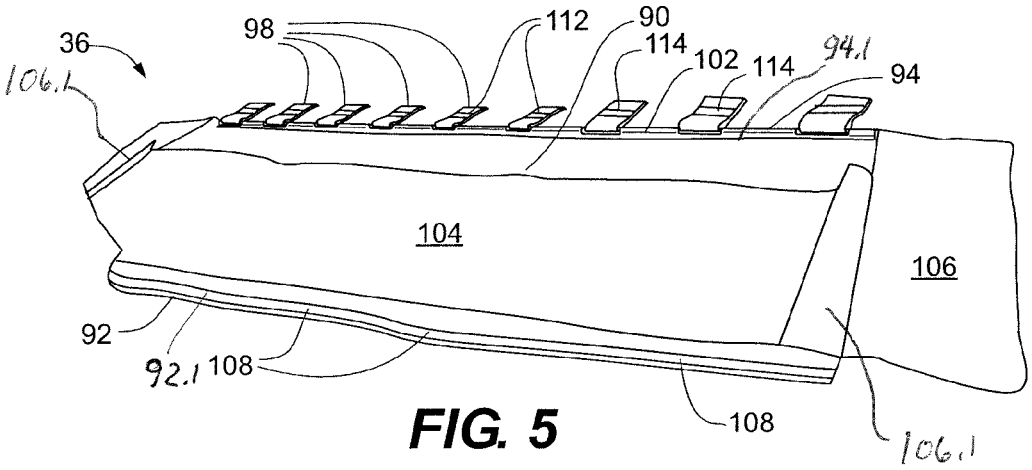

Referring to FIGS. 4 and 5, the textile deck assembly 36 is depicted in more detail according to an embodiment of the disclosure. The textile deck assembly 36 includes a platform portion 90 including a forward edge 92, a rearward edge 94, and side edges 96. Each edge of the platform portion having an edge portion, a forward edge portion 92.1, a rearward edge portion 94.1, and side edge portions 96.1. A plurality of straps 98 extend from the rearward edge 94 and edge portion 94.1. In some embodiments, one or more yoke members 102 (more clearly depicted in FIG. 6) are coupled to the platform portion 90 proximate to and extending along the rearward edge 94. The straps 98 also may be coupled to the yoke member(s) 102. The yoke member(s) 102 may be metallic, polymeric, or of a textile or rope material. In some embodiments, the straps 98 extend underneath the backrest portion of the at least one cushion 38. In the depicted embodiment, the textile deck assembly 36 includes a fleece or cushion layer 104 attached, for example, proximate the forward edge 92 of the platform portion 90. Also in the depictions of FIGS. 4 and 5, side skirt portions 106 and/or stapling strips 106.1 may be attached at the side edges 96 and side edge portions 96.1 of the platform portion 90.

Figure 11:
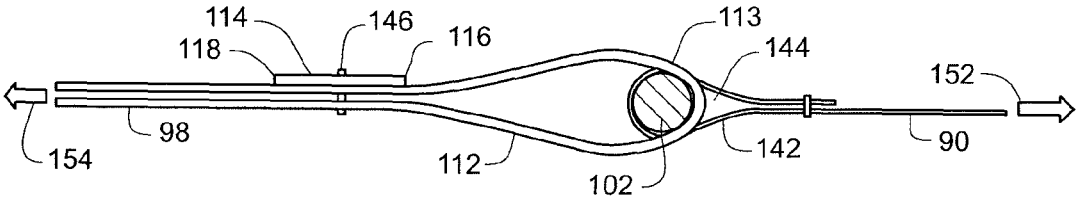
FIG. 11 is a partial sectional view of the textile deck assembly of FIG. 9 according to an embodiment of the disclosure.

In the depicted embodiment, guide strips 108 are aligned substantially with the forward edge 92 of the platform portion 90 and attached to the platform portion 90. While a plurality of guide strips 108 are depicted, a single guide strip 108 extending the length of the forward edge 92 is also contemplated. The guide strip(s) 108 may be made of a material suitable for driving fasteners (e.g., staples or screws) therethrough, such as a thin layer of cardboard, tag board, or polymer, or a textile strip. In some embodiments, the straps 98 are looped around the yoke member(s) 102 to form strap loops 112 at a forward end 113. Each of the straps 98 may be fitted with a stiffening band 114 attached to the respective strap 98, each stiffening band 114 including a forward edge 116 and a rearward edge 118 (FIG. 11). The stiffening bands 114 may be made of a material suitable for driving fasteners (e.g., staples, tacks, or screws) therethrough, such as thin layers of cardboard, tag board, polymer, or a textile strip. In some embodiments, the stiffening bands 114 are positioned on the straps 98 at a predetermined distance from the yoke member(s) 102. Also, other markings at predetermined locations may be placed on the straps 98, identified and discussed below attendant to FIGS. 15-17.

Example materials for the platform portion 90 include a canvas or tent-like material, such as a woven fabric of polyester having a linear mass density of 1200 denier (D) (e.g., 1200D×1200D polyester). In some embodiments, the platform portion 90 includes a coating on at least one side to inhibit fraying of the textile fibers and to inhibit local separation of the woven fabric. The coating may be, for example, of a polyethylene or polyurethane material. Example materials for the straps 98 include a blend of propylene (PP) and rubber thread interwoven together. In one embodiment, the straps 98 comprise an interwoven composition of PP flat yarn having a linear mass density of 1000D, PP multifilament yam of 1200D, and 24 gauge bare rubber thread, with a maximum elongation of 90% relative to the unstressed length. In one embodiment, the nominal width (lateral dimension in FIG. 1) of each strap 98 range from 48 mm to 50 mm in width inclusive in a no-load condition. Herein, a range of values that is said to be "inclusive" includes the end point values of the stated range, as well as all values between the end point values.

Figure 6:
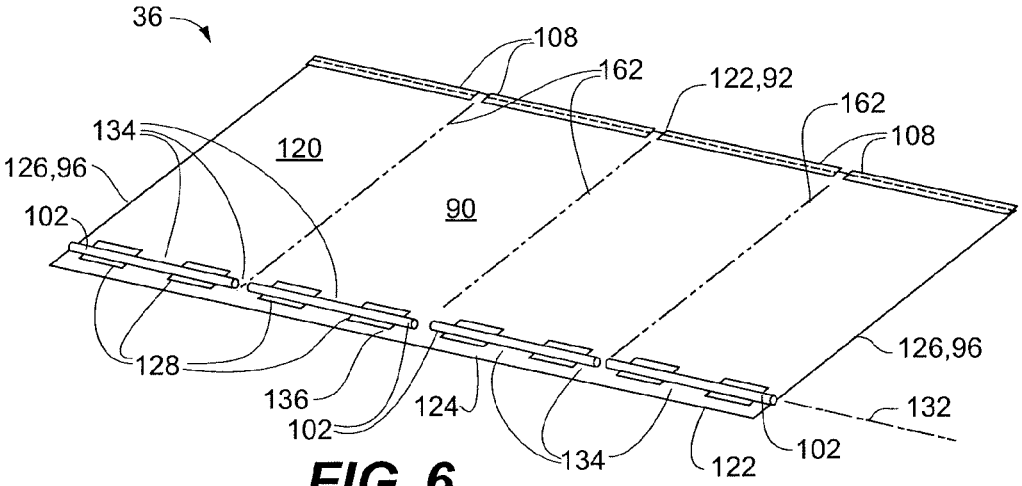
FIGS. 6 through 9 are perspective views depicting fabrication steps of a textile deck assembly according to an embodiment of the disclosure.

Referring to FIGS. 6 through 12, fabrication of an embodiment of the textile deck assembly 36 is depicted according to an embodiment of the disclosure. The platform portion 90 may be formed from a rectangular-shaped textile 120 having a forward edge 122, a rearward edge 124, and side edges 126. A plurality of cutouts 128 may be formed proximate the rearward edge 124, centered along a yoke axis 132 that extends substantially parallel to the rearward edge 124 (FIG. 6). The cutouts 128 define a plurality of tab members 134 therebetween, the tab members extending to a margin strip 136 at the rearward edge 124. The yoke member(s) 102 may be disposed along the yoke axis 132, so that the yoke member(s) 102 bridge the tab members 134 over the cutouts 128. The guide strip(s) 108, when utilized, are aligned flush with the forward edge 122 of the textile 120, for example by a sewing, stapling, adhesion or a fusion process.

Figure 7:
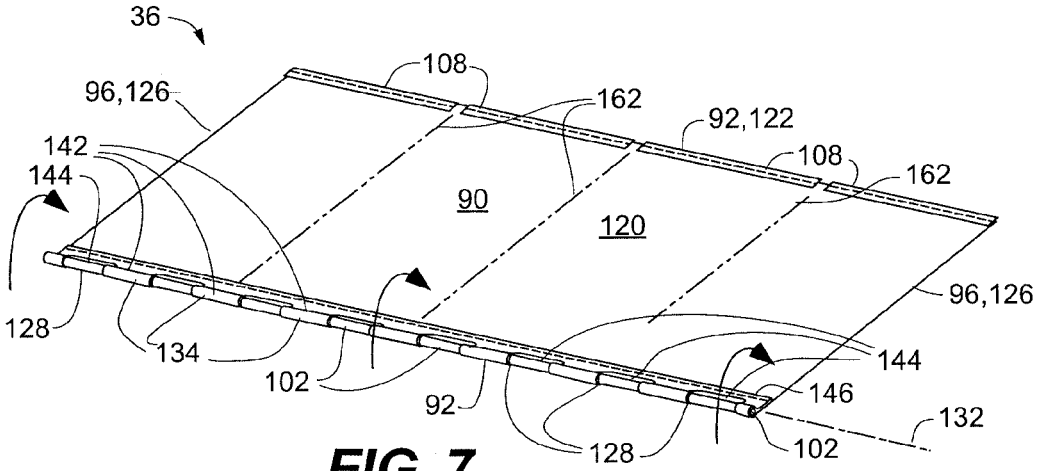
Figure 8:
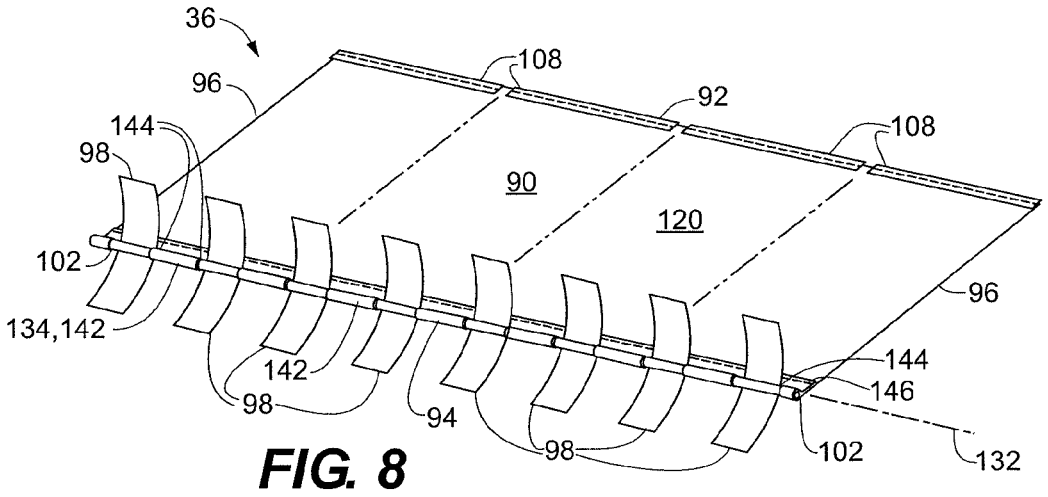

The rearward edge 124 is folded about the yoke axis 132, and the margin strip 136 attached to the body of the textile 120 (FIG. 7). In the depicted embodiment, attachment of the margin strip 136 is made by sewing along a stitch line 146 using standard sewing techniques available to the artisan. Alternatively, the margin strip 136 may be attached to the body of the textile 120 by a stapling, riveting, adhesion or fusion process. The tab members 134, having been folded about the yoke axis 132, form a plurality of platform loops 142 that capture the yoke member(s) 102. The cutouts 128 define a plurality of slots 144 between the yoke member(s) 102 the textile 120, and the platform loops 142, the yoke member(s) 102 being exposed adjacent to the plurality of slots 144. While the depicted embodiment presents the folding about the yoke axis 132 with the yoke member(s) 102 in place, the yoke member(s) 102 may alternatively be inserted into the platform loops 142 after the folding operation, to the same effect. It is further contemplated that the platform loops may be formed by attachment of a separate piece or pieces of fabric (not depicted) to the rearward edge 94, rather than the integral folded arrangement of FIGS. 6 and 7.

Figure 9:
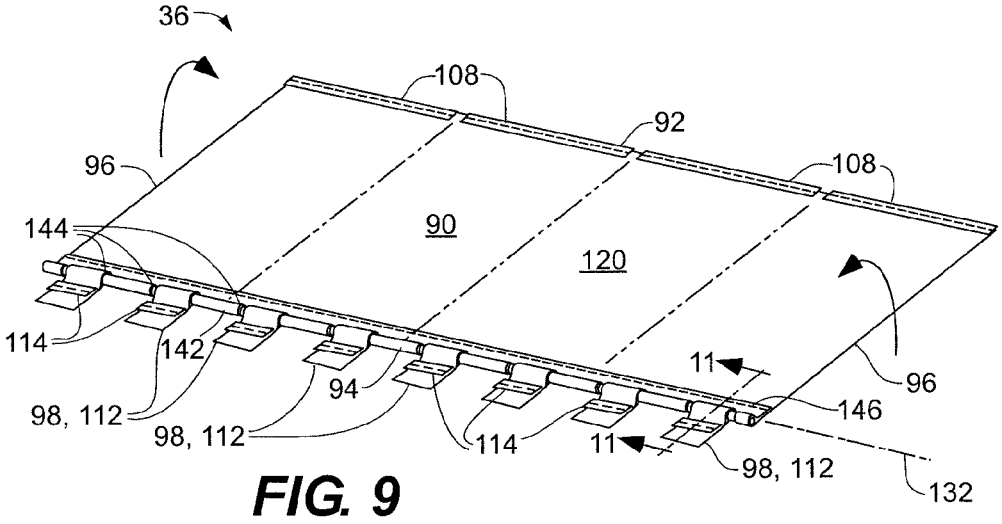

At this point in the assembly (FIG. 7), the platform portion 90 is defined, with the forward and side edges 92 and 96 corresponding to the forward and side edges 122 and 126 of the textile 120, and the rearward edge 94 of the platform portion 90 corresponding to the rearward extremity of the folded platform loops 142. The straps 98 are inserted through the slots 144 defined between the yoke member(s) 102 and the textile 120 (FIG. 8), and folded over the exposed portions of the yoke member(s) 102 to form the strap loops 112 (FIG. 9). The overlapping portion of the strap loops 112 may be joined together, for example by a sewing, stapling, riveting, adhesion, or a stapling process. In this way, the yoke member(s) 102 are captured within the forward end 113 of the strap loops 112 as well as within the platform loops 142. The platform loops 142 at the corners of the 90 may be partially or completely sewn shut (not depicted) at the side edges 96 to capture the yoke member(s) 102 within the plurality of platform loops 142 and prevent the yoke member(s) 102 from sliding laterally out of the platform loops 142. The stiffening bands 114, when utilized, may be fastened to the straps 98, for example, by a sewing, stapling, riveting, adhesion, or a stapling process. In some embodiments, the joining of the overlapping portion of the strap loops 112 and the attachment of the stiffening bands 114 are performed simultaneously, i.e., in a single joining operation. The side skirt portions 106 comprising upholstery panels and the fleece layer 104 may be attached to the platform portion 90, as depicted in FIGS. 4 and 5, for example by a sewing, stapling, riveting, adhesion, or a stapling process. The rectangular platform of sheet material can have upholstery panels attached thereto on all four edge portions for facilitating subsequent assemble of a sofa or chair. See U.S. Pat. Pub. US 2017/0105545 which is incorporated herein by reference in its entirety for all purposes.

Figure 10:
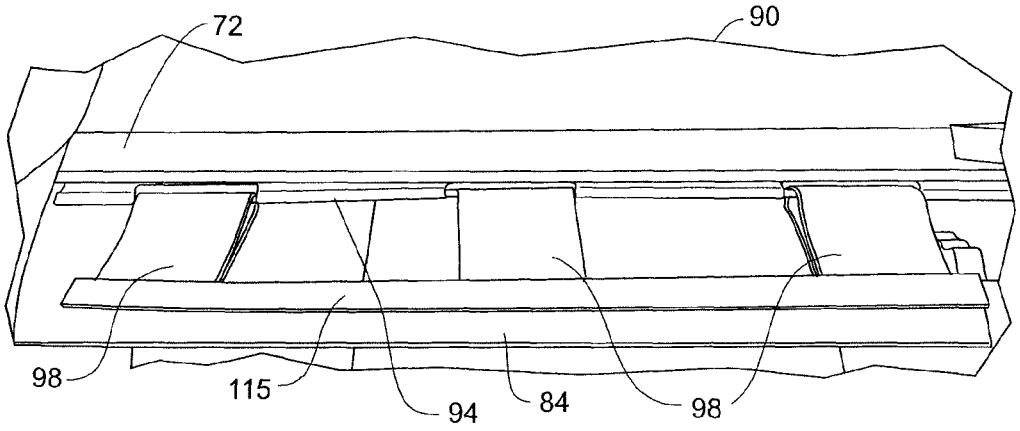
FIG. 10 is a partial perspective view of a stiffener spanned across multiple straps of a textile deck assembly according to an embodiment of the disclosure.

The embodiments depicted at FIGS. 4, 5, and 9 illustrate individual stiffeners 114 affixed to each of the plurality of straps 98. Alternatively, an extended stiffener 115 may be attached to multiple straps 98, as depicted in FIG. 10. The depicted extended stiffener 115 is coupled to three straps 98, but could be strapped to two straps 98 or more than three straps 98. The extended stiffener 115 includes the same characteristics as the stiffeners 114 (i.e., the forward edge 116 and the rearward edge 118), and may be affixed to the multiple straps 98 in the same way as the stiffeners 114.

In the depicted embodiment, a plurality of yoke members 102 are depicted end to end along the yoke axis 132 (FIG. 6), as well as the plurality of guide strips 108. The yoke members 102 and the guide strips 108 are of approximately equal length and being in approximate lateral alignment along the opposed forward and rearward edges 92 and 94.

As such, folding axes 162 are defined that run between adjacent ends of the yoke members 102 and adjacent ends of the guide strips 108, the folding axes 162 being substantially perpendicular to the forward and rearward edges 122 and 124 of the textile 120. Optionally, a single, full length guide strip 108 may be used, compliant enough to be folded without being damaged or weakened. The yoke member(s) 102 may be of a stiff form, for example, rod(s), bar(s), or tubing. Alternatively, the yoke member(s) 102 may also be somewhat compliant, for example, braided cable(s), rope(s), or strap(s). Compliant yoke member(s) 102 may require local anchoring (not depicted) to the textile deck assembly 36, for example by fastening, adhesion, or fusing within the platform loops 142. In some embodiments, the yoke member(s) 102 are not routed within platform loops, but instead fastened to the rearward edge (e.g., straps or ropes sewn or riveted onto the rearward edge 124, as depicted in FIG. 30A).

Functionally, the yoke member(s) 102 are acted upon by both the strap loops 112 and the platform loops 142 (FIG. 11). Due to the tensioning of the textile deck assembly 36 when mounted to the seat frame assembly 32, a forward force 152 on the platform loops 142 which is transferred to the yoke member(s) 102. A rearward force 154 is exerted on the straps 98 which is also transferred to the yoke member(s) 102. For compliant yoke member(s) 102, local anchoring to the platform portion 90 prevent the compliant yoke member(s) 102 from being pulled through folded cutouts 128. For rigid yoke member(s) 102, the tension forces 152 and 154 maintain the yoke member(s) 102 in a substantially fixed lateral position within the loops 112 and 142. In the depicted embodiment, the textile deck assembly 36 may be folded substantially along the folding axes 162 for compact shipping as a kit 164. In this way, the textile deck assembly 36 may be manufactured at one facility, and economically shipped to another facility for installation within the seat frame assembly 32.

The stiffener members 114, when utilized, can assist the assembler in handling of the straps 98, helping to maintain the width (lateral dimension) of the straps 98 during assembly so that the straps are properly laid out on the rearward rail 84. The extended stiffener member 115 (FIG. 10), when utilized, can assist the assembler the same way, in addition to maintaining the correct lateral spacing between multiple straps 98 during assembly.

Figure 13:
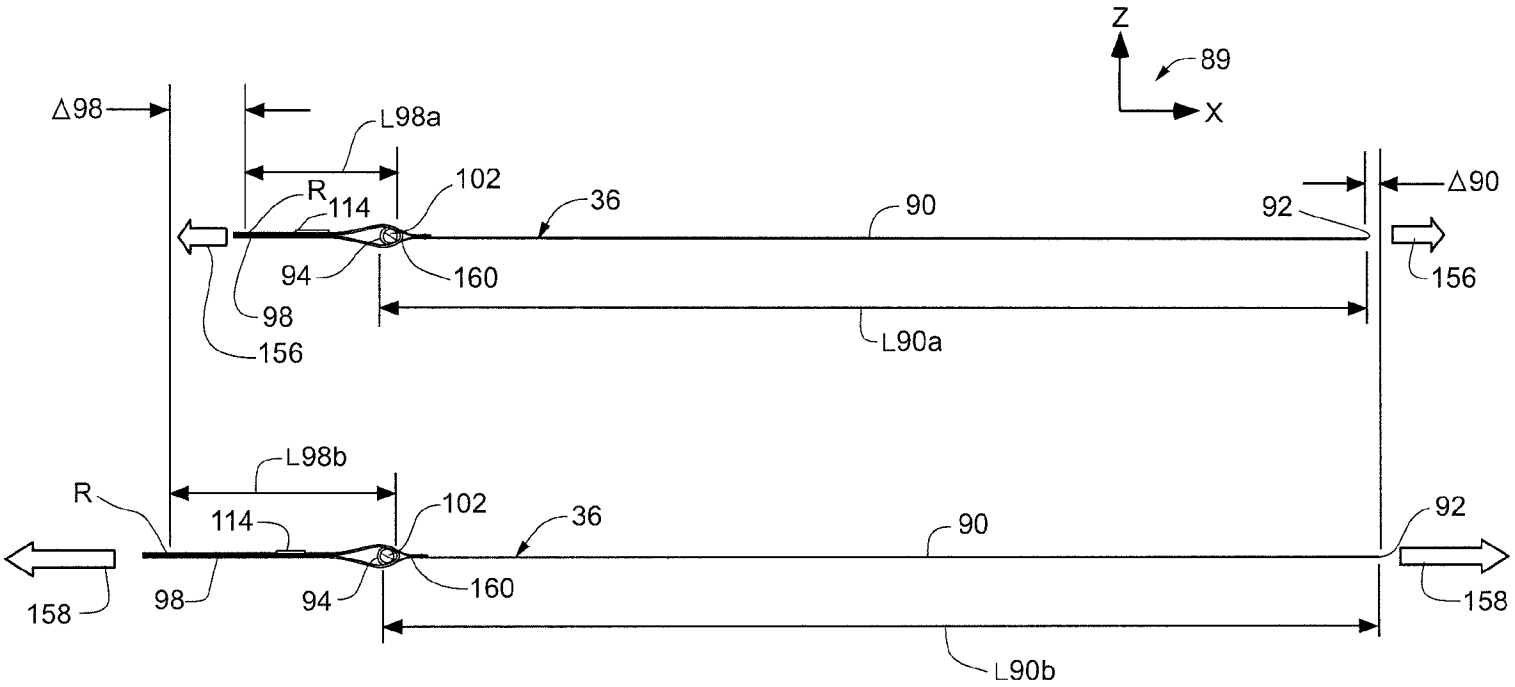
FIG. 13 is a schematic view depicting the relative elongation of a platform portion and a plurality of straps under fore and aft tension loads according to an embodiment of the disclosure.
Figure 14:
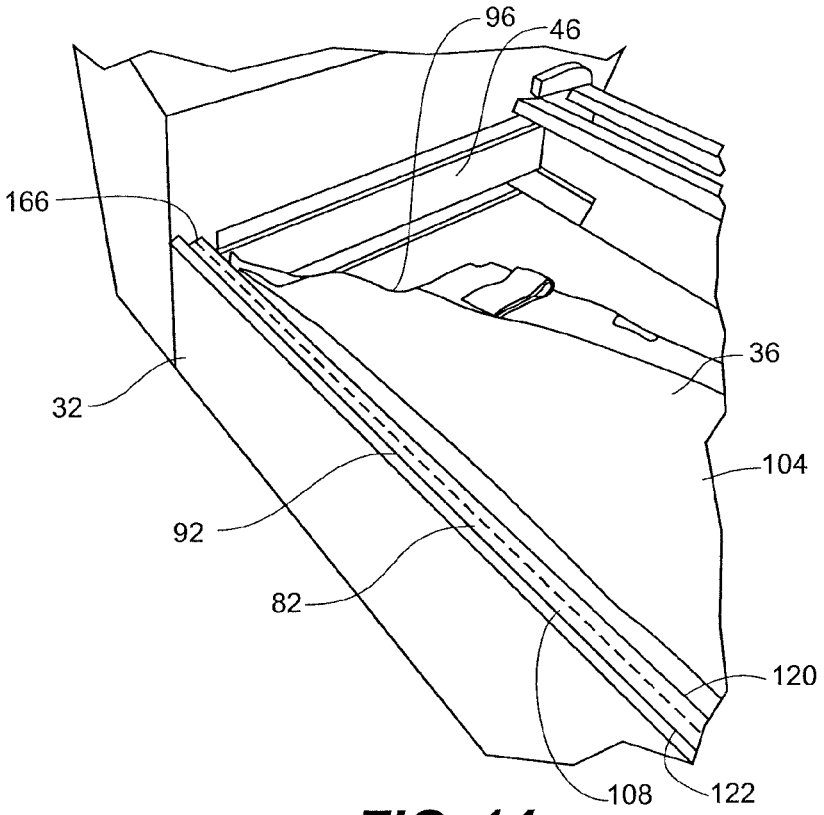
FIGS. 14 through 17 depict assembly steps for installing a textile deck assembly onto a seat frame assembly according to an embodiment of the disclosure.

Referring to FIG. 13, a characterization of the relative elongations of the platform portion 90 and the straps 98 is depicted in an embodiment of the disclosure. In some embodiments, the platform portion 90, while flexible and compliant, is more resistant to stretching under a load than are the straps 98, so that the platform portion 90 undergoes substantially less elongation under a tension load than do the plurality of straps 98. This effect is illustrated in FIG. 13, which schematically compares a textile deck assembly 36 under a first tension load 156, and the same textile deck assembly 36 under a second tension load 158, the second tension load 158 being greater than the first tension load 156. The tension load 156 represents the tension on the textile deck assembly 36 in a no-load condition (e.g., without an occupant seated on the furniture assembly 30) and is caused by tensioning of the textile deck assembly 36 during assembly.

The tension load 158 represents the tension on the textile deck assembly 36 due to installation of the textile deck assembly 36 in a loaded condition (e.g., with an occupant seated on the furniture assembly 30) and is caused by the combination of the load and the tensioning of the textile deck assembly 36 during assembly. The tension loads 156 and 158 are depicted as being exerted in the fore-and-aft direction (i.e., parallel to the x-axis of the Cartesian coordinate 89 of FIG. 1). Of course, it is recognized that, particularly in a loaded condition, the textile deck assembly 36 will not be linear as depicted, but the principles described are true for linear as well as non-linear tensioning.

Fore-and-aft dimensions of the platform portion 90 are identified as L90*a* and L90*b* for the textile deck assembly 36 under the first and second tension loads 156 and 158, respectively. The L90*a* and L90*b* dimensions are taken from the rearward edge 94 to the forward edge 92 of the platform portion 90. Fore-and-aft dimensions of the plurality of straps 98 are identified as L98*a* and L98*b* for the same textile deck assembly 36 under the first and second tension loads 156 and 158, respectively. For each of the plurality of straps 98, a forward datum for the dimensions L98*a* and L98*b* is from a forward extremity 160 where the strap 98 loops around and contacts the yoke member(s) 102, and a rearward datum is taken to the a reference line R corresponding to a nominal location on the strap 98 where the strap 98 is anchored to the rearward rail 84. For example, for seat box assemblies 32 where the strap 98 is stapled to an upper face 188 of the rearward rail 84, the nominal location would be a line 161 representing an average location of the forward-most staples, identified in FIG. 18. For seat box assemblies where closed loop straps 298 are clipped to the rearward rail 84 with strap clips 300, the nominal location is the looped rearward end 306 of the strap 298 (see FIGS. 26 through 29D).

Upon increasing from the tension load 156 to the tension load 158, the platform portion 90 and the plurality of straps 98 generally experience average elongations Δ90 and Δ98, respectively. In some embodiments, an elongation ratio Δ90/Δ98 of the average elongation Δ90 of the platform portion 90 to the average elongation Δ98 of the plurality of straps 98 is less than 1:4; that is, for such an embodiment, if the average elongation Δ98 of the plurality of strap is 2 inches, the average elongation Δ90 of the platform portion 90 would be less than ½ inches. In some embodiments, the elongation ratio Δ90/Δ98 is less than 1:8; in some embodiments, the elongation ratio Δ90/Δ98 is less than 1:16; in some embodiments, the elongation ratio Δ90/Δ98 is less than 1:32.

Referring to FIGS. 14 through 17, assembly of the textile deck assembly 36 onto the seat frame assembly 32 is depicted according to an embodiment of the disclosure. When provided as a kit 164, the textile deck assembly 36 is unfurled, and the guide strip(s) 108 are aligned with the forward rail 82 at a forward corner 166 of the seat frame assembly 32. Starting at the corner 166, the forward edge 92 of the platform portion 90 is attached to forward rail 82 (FIG. 14), along the entire length of the forward rail 82. Attachment may be made with fasteners that pass through the guide strip(s) 108 and the textile 120 proximate the forward edge 122. In the depicted embodiment, the fasteners are staples which are centered nominally in 1 inch increments. In some embodiments, the nominal centering is in the range from 0.5 to 1.5 inches inclusive.

Figure 15:
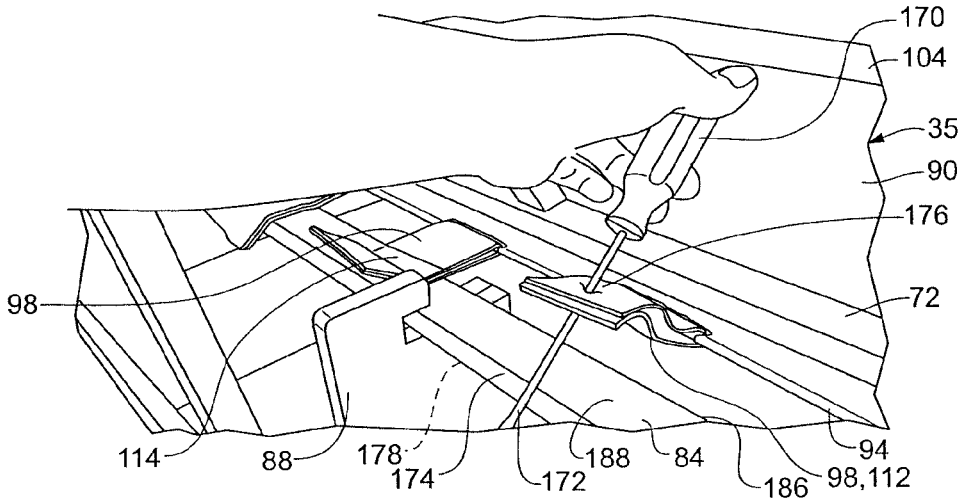

With the forward edge 92 of the platform portion 90 attached to the forward rail 82, the rearward edge 94 of the textile deck assembly 36 is pulled toward the rearward rail 84, and at least one of the side edges 96 aligned with the adjacent corresponding side wall 46. The straps 98 are pulled taut and attached to the rearward rail 84. In the FIGS. 15 through 18 embodiment, the straps 98 are pulled taut with a pull tool 170. The pull tool 170 includes a shaft 172 that is inserted through the strap 98 (FIG. 15). In some embodiments, an aperture or slit 176 is pre-formed at a predetermined location on the strap 98 for insertion of the shaft 172. The pre-formed slit 176 may be fitted with an eye (not depicted) to facilitate insertion of the shaft 172 by an automated machine. In other embodiments, the shaft 172 includes a cutting feature (not depicted) that forms the slit 176 through the strap 98 during installation of the textile deck assembly 36; the strap 98 may include a mark (not depicted) at a predetermined location on the strap 98 where the slit 176 is to be formed.

Figure 16:
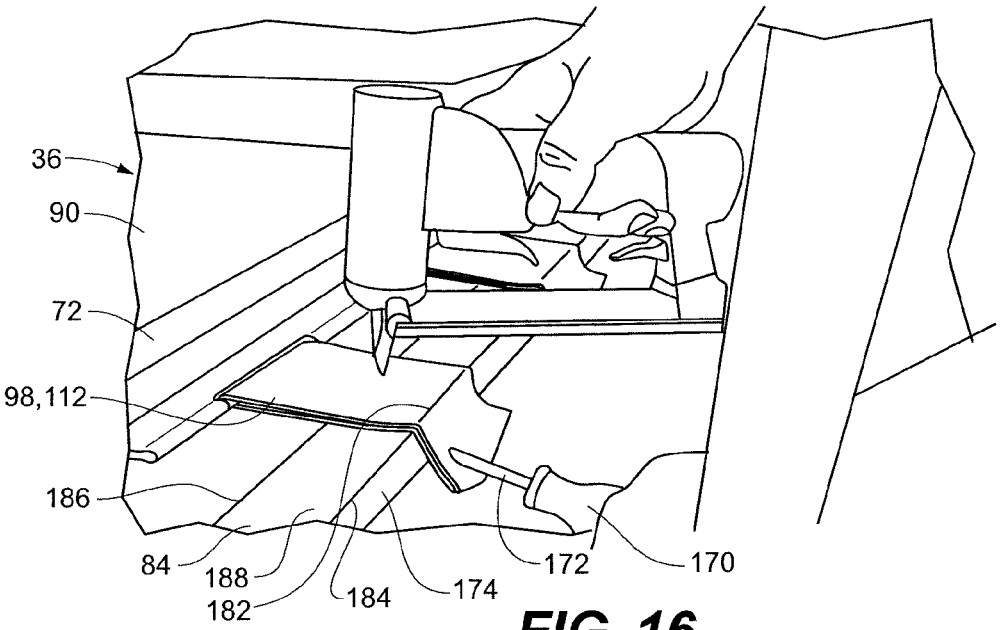

The shaft 172 is inserted through the aperture or slit 176 and brought into contact with a rearward face 174 of the rearward rail 84 (FIG. 15). The pull tool 170 is then rotated rearward with the shaft 172 riding against the rearward face 174, so that the shaft 172 is in contact with an underside 178 of the rearward rail 84 (FIG. 16). This action pulls the textile deck assembly 36 taut against the secured front edge 92 of the platform portion 90.

In some embodiments, the strap 98 includes a reference mark 182, such as a sewn seam or an ink line (FIG. 16), to assist the assembler with proper placement of the straps 98 on the rearward rail 84. For sewn seam marking, the stitching may be of a color that stands out relative to the color of the strap 98 for easy identification. The mark 182 is disposed at a predetermined distance from the yoke member 102 to which the strap 98 is coupled. In the depicted embodiment, the reference mark 182 is located to align with an upper corner 184 of the rearward face 174 of the rearward rail 84. In embodiments that utilize stiffening bands 114 (FIG. 15), the stiffening bands 114 may be located at a predetermined location on the strap 98, so that the forward edge 116 or the rearward edge 118 are in alignment or approximate alignment with features of the rearward rail 84. For example, in one embodiment, the stiffening bands 114 are at a location where the forward edges 116 are approximately ¼ inch rearward of a forward edge 186 of the rearward rail 84.

Figure 17:
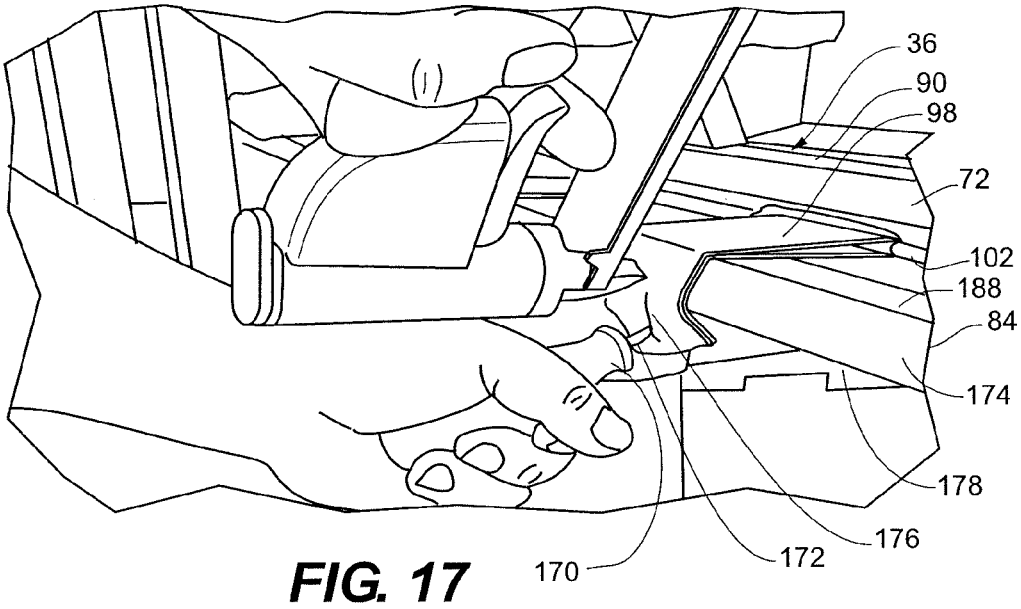

The pull tool 170 is used to properly position the strap 98 on the rearward rail 84 by leveraging the shaft 172 against the rearward face 174 or the underside 178 of the rearward rail 84, with the shaft inserted through the slit or aperture 176. When properly positioned, the strap 98 is fastened to the rearward rail 84. In some embodiments, the straps 98 are secured to a top face 188 of the rearward rail 84 (FIG. 16), as well as to the rearward face 174 of the rearward rail 84 (FIG. 17). Attachment of the straps 98 to the rearward rail 84 may be made, for example, by a stapling process, as depicted. Other fasteners may also be used, including tacks, screws, or clamps.

Functionally, the displacement of the platform portion 90 and straps 98 required to align the marks (e.g., line 182 or edge 116, 118 of stiffening band 114) with features of the rearward rail 84 is predetermined to provide the desired installation tension force on the textile deck assembly 36 after installation on the seat frame assembly 32. In some embodiments, the installation tension force on each strap 98 is in a range of 30 pounds-force (lbf) to 70 lbf inclusive; in some embodiments, the installation force is in a range of 40 lbf to 60 lbf inclusive; in some embodiments, the installation force is in a range of 45 lbf to 55 lbf inclusive. In one embodiment, the installation tension force is nominally 51 lbf. This is substantially lower than the nominal 65 lbf installation force required to install sinuous springs in conventional furniture assemblies.

In terms of distributed installation force along the rearward edge 94 of the textile deck assembly 36 that is imparted by the straps 98, various embodiments provide distributed installation forces, expressed in terms of force per lineal unit (e.g., lbf/in.), along the yoke member(s) 102 that is in a range of 4 lbf/in. to 9 lbf/in. inclusive; in some embodiments, the distributed installation force is in a range of 5 lbf/in. to 8 lbf/in. inclusive; in some embodiments, the distributed installation force is in a range of 6 lbf/in. to 7 lbf/in. inclusive. In one embodiment, the distributed installation tension force is nominally 6.5 lbf/in. to 6.75 lbf/in. Accordingly, based on the distributed installation tension force of 18 lbf/in. that is typical of conventional sinuous spring furniture assemblies, the distributed installation tension force of the disclosed embodiments are significantly reduced to a range that is within 20% to 50% of conventional sinuous spring assemblies.

While the pull tool 170 depicted herein is suitable for manual operation, the characteristics of the pull tool 170 and its operation are not limited to manual operation. That is, it is contemplated that the same components and characteristics described for the pull tool 170 may be incorporated into a machine for automated or semi-automated installation of the textile deck assembly 36 onto the seat frame assembly 32.

Because of the relative elasticity of the straps 98 and the platform portion 90, the straps 98 undergo a greater elongation than does the platform portion 90 when the textile deck assembly 36 is subject to a load. The cross-brace(s) 74 mitigates bowing of the front and back walls 42 and 44 toward each other due to the tension load placed on the textile deck assembly 36. Placement of the cross-brace(s) 74 proximate a lower plane of the seat frame assembly 32 allows for downward deflection of the textile deck assembly 36 during use. The forward and rearward gussets 86 and 88 effectively provide stiffening of the forward and rearward rails 82 and 84. The forward and rearward gussets 86 and 88, and the forward gusset 86 in particular, may also respectively mitigate twisting of the front and back walls 42 and 44 that may otherwise occur due to the vertically off-center placement of the cross-brace(s) 74 within the seat frame assembly 32. In an RTA furniture assembly 31 (FIG. 1A), the interior side walls 46*a* and 46*b* may functionally serve the same purpose as the cross brace 74, so that a separate cross brace may not be necessary.

The guide strip(s) 108 make handling of the forward edge 92 of the platform portion 90 easier for the assembler, and provides ready alignment of the forward edge 92 along the forward rail 82.

Figure 18:
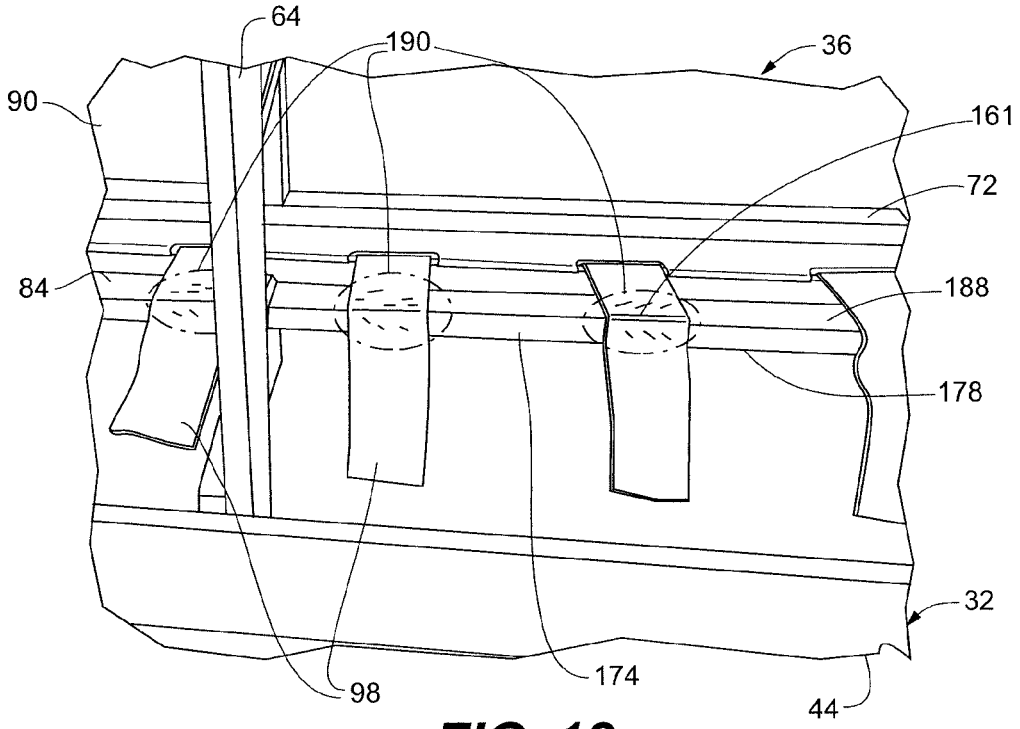
FIG. 18 is a partial rear perspective view of a seat frame assembly with textile deck assembly installed according to an embodiment of the disclosure.
Figure 19:
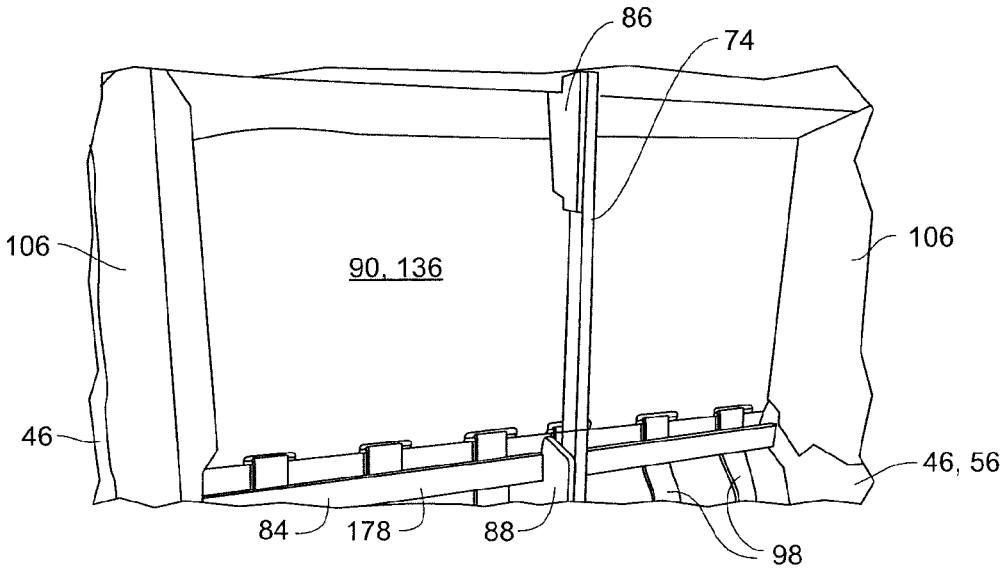
FIG. 19 is a partial bottom perspective view of the seat frame assembly of FIG. 18 with skirt portions secured to the seat frame assembly according to an embodiment of the disclosure.

Referring to FIGS. 18 and 19, additional views of the seat frame assembly 32 after installation of the textile deck assembly 36 are depicted according to an embodiment of the disclosure. The fastening (stapling) pattern 190 for affixing the straps 98 to the top face 188 and the rearward face 174 of the rearward rail 84 is seen in FIG. 18, with the platform portion 90 stretched taut to the forward rail 82. Note that the lower backrest rail 72 is in the foreground in FIG. 18, and does not contact or otherwise influence the textile deck assembly 36. The side skirt portions 106 and/or stapling portions may be tucked into the interior space 48 of the seat frame assembly 32 and affixed (e.g., stapled) to the side walls 46, as depicted in FIG. 19, thereby attaching the side edges 96 and side edge portions 96.1 to the wood seat frame assembly.

Figure 20:
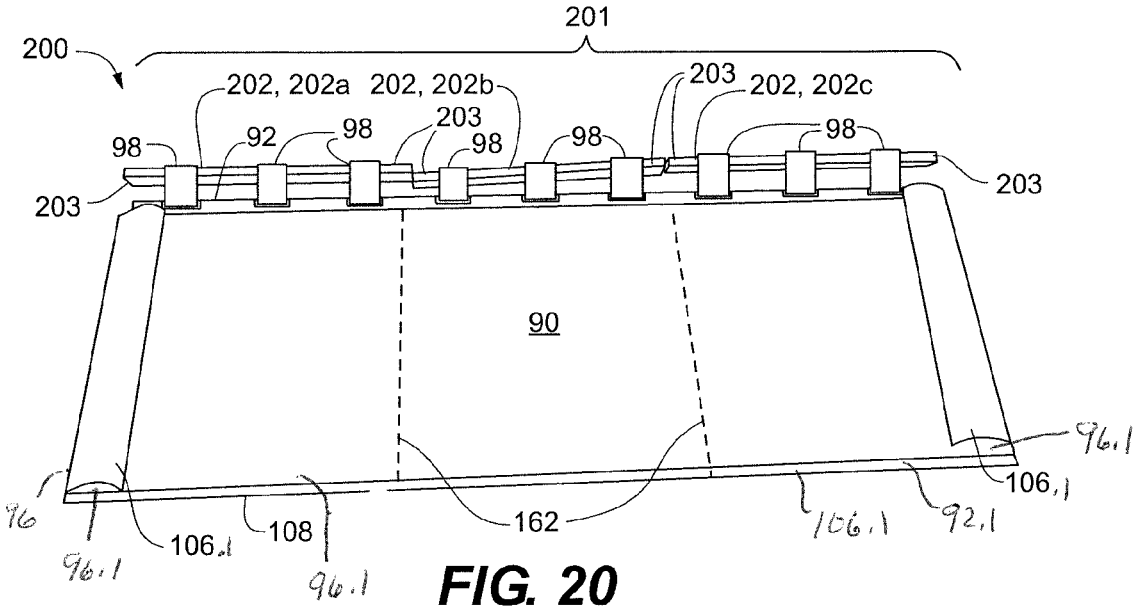
FIG. 20 is a perspective view of a textile deck assembly having rearward rail sections according to an embodiment of the disclosure.

Referring to FIG. 20, a textile deck assembly 200 that includes segmented rearward rail 201 is depicted according to an embodiment of the disclosure. The textile deck assembly 200 includes many of the same components and attributes as the textile deck assembly 36, some of which are indicated with same-numbered reference characters. The side edge portions 96.1 and front edge portion 92.1 may include stapling strips 106.1. In the depicted embodiment of the textile deck assembly 200, the segmented rearward rail 201 includes three rearward rail segments 202*a*, 202*b*, and 202*c*, which may be included as part of the textile deck assembly 200. That is, the textile deck assembly 200 may be pre-assembled with the straps 98 affixed to the rearward rail segments 202*a*, 202*b*, and 202*c* prior to shipment to an assembly shop. Herein, the rearward rail segments 202*a*, 202*b*, and 202*c* are referred to collectively or generically as rearward rail segment(s) 202. Each of the rearward rail segments 202 includes end portions 203.

Figure 21A:
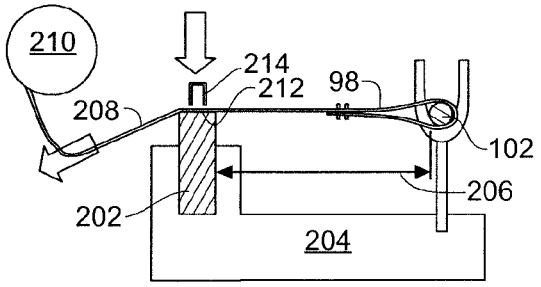
FIGS. 21A and 21B are schematic views of the assembly of straps to the textile deck assembly of FIG. 20 according to an embodiment of the disclosure.
Figure 21B:
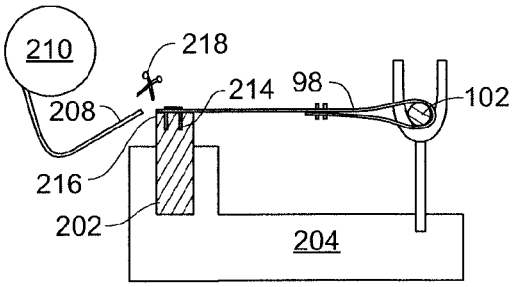

Referring to FIGS. 21A and 21B, assembly the straps 98 to the textile deck assembly 200 is depicted according to an embodiment of the disclosure. In the depicted embodiment, the yoke members 102 and rearward rail segments 202 are mounted in a fixture 204 that maintains a predetermined separation 206 between the yoke members 102 and rearward rail segments 202. Strap material 208 (depicted as a roll in FIG. 21A) for a given strap 98 may be looped around the respective yoke member 102 as described attendant to FIGS. 8 and 9 above. While in the fixture 204, the strap material may be stretched over a rearward edge 212 of the rearward rail segment 202 and affixed thereto, for example with staples 214. The strap material may then be cut flush with a corner 216 of the respective rearward rail segment 202, as represented by the scissors icon 218 in FIG. 21B. The cut may be executed, for example, with a shears, utility blade, laser cutter, or other material cutting devices and techniques available to the artisan. In some embodiments, the cut end of the strap 98 is heat seared to melt the strands together and prevent separation of the strands of the strap 98.

Figure 12:
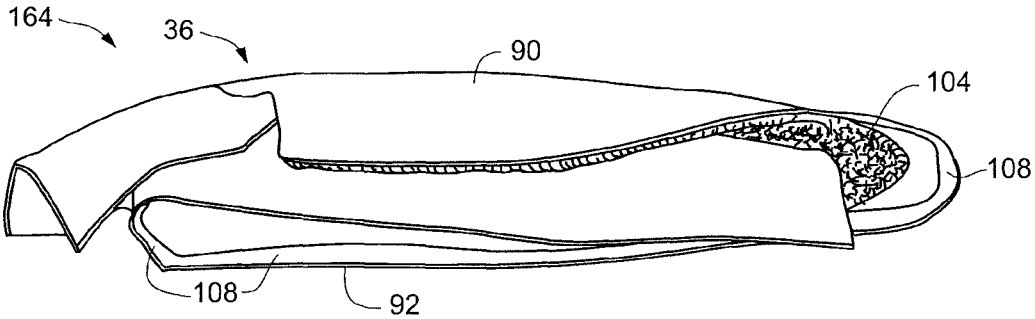
FIG. 12 is an end view of the textile deck assembly of FIG. 9 in a folded kit configuration according to an embodiment of the disclosure.

Functionally, the segmenting of the segmented rearward rail 201 enables the rearward rail segments 202*a*, 202*b*, and 202*c* to be included in the textile deck assembly 200 and still folded akin to the depiction of FIG. 12 for shipping. The segmenting also enables shorter spans for less deflection due to the tension load, both during installation and in use. Also, by segmenting the rearward rail, the forces required for installing a given segment is less than would be for installing a full length rail. For example, in the depicted embodiment, the force required to install any one of the rearward rail segments 202 is approximately one third of the force that would be required to install a full length rail in the same manner as depicted in FIGS. 22A through 22C (below).

Furthermore, the process of fabrication described attendant to FIGS. 21A and 21B requires less strap material than the fabrication process described attendant to FIGS. 15 through 18, because excess material for the rotation step of FIG. 16 is not required. That is, the material that is cut from the straps 98 remains for the fabrication of additional straps 98 (for example on a spool 210 as depicted in FIGS. 21A and 21B). In many assemblies, the strap material 208 is a relatively high cost material relative to the other materials of construction. Accordingly, the fabrication described attendant to FIGS. 21A and 21B can result in substantial material cost savings over the fabrication process described attendant to FIGS. 15 through 18.

Figure 22:
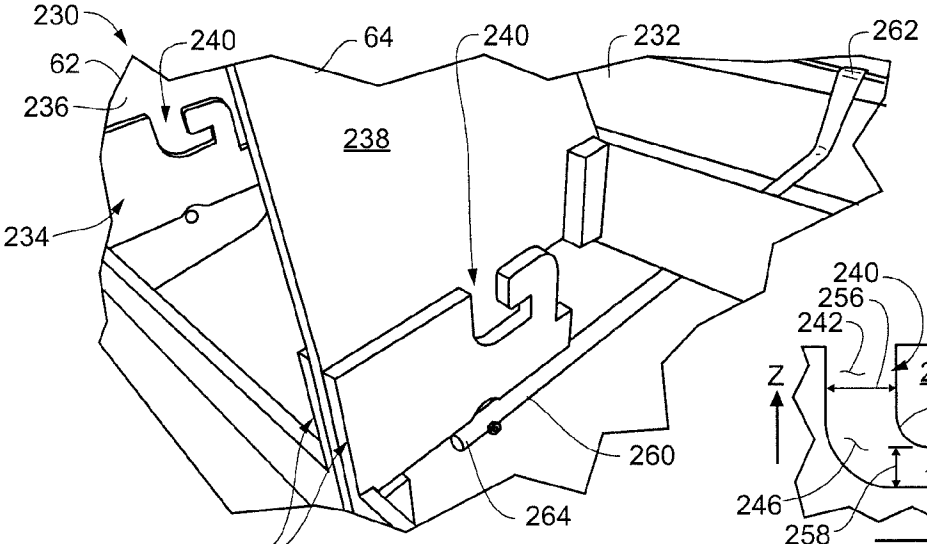
FIG. 22 is a perspective view of rearward mounting brackets in an assembly for mounting the rail sections of FIG. 20 according to an embodiment of the disclosure.
Figure 22A:
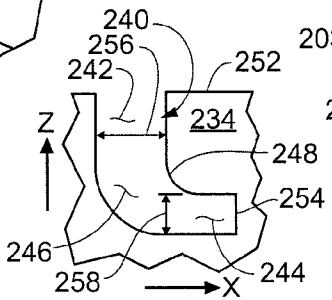
FIG. 22A is a partial, side elevational view of a mounting notch of the rearward brackets of FIG. 22.
Figure 25:
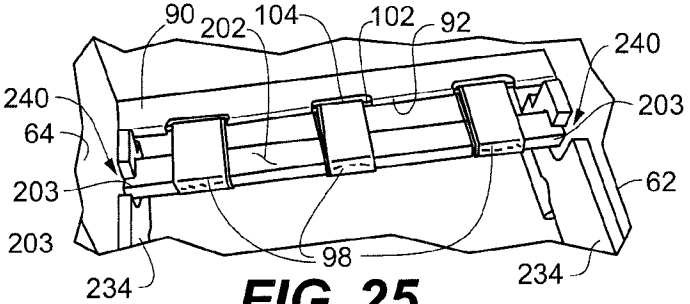

Referring to FIGS. 22 and 22A, configuration of a furniture assembly 230 with a seat box 232 configured to accept the segmented rearward rail 201 is depicted according to an embodiment of the disclosure. The furniture assembly 230 and seat box 232 may include many of the same components and attributes as the furniture assembly 30 and seat box 32 of FIGS. 1 through 3, some of which are indicated with same-numbered reference characters in FIG. 22. In the depicted embodiment, the furniture assembly 230 includes rearward mounting brackets 234 that are affixed to an inward-facing lateral surface 236 of the side uprights 62, and to both lateral surfaces 238 of the mid-uprights 64. By this arrangement, there are rearward mounting brackets 234 that face each other between adjacent uprights 62, 64 (FIG. 25).

In the depicted embodiment, each rearward mounting bracket 234 defines a mounting notch 240 having a vertical portion 242 and a horizontal portion 244 joined by a transition portion 246. The transition portion 246 may be bounded by at least one arcuate surface 248 (FIG. 22A). The vertical portion 242 is accessible from a top edge 252 of the rearward mounting bracket 234. The horizontal portion 244 of the mounting notch 240 extends forward relative to the horizontal and transition portions 244 and 246, and is bounded by an abutment 254 at the forward end. The vertical portion 242 is characterized as having a width dimension 256 in the fore-and-aft direction (i.e., parallel to the x-axis of the Cartesian coordinate 89 of FIG. 1), and the horizontal portion 244 is characterized as having a height dimension 258 in the vertical direction (i.e., parallel to the z-axis of the Cartesian coordinate 89 of FIG. 1). In the depicted embodiment, the width dimension 256 of the vertical portion 242 is greater than the height dimension 258 of the horizontal portion 244.

Also in the depicted embodiment, the seat box 232 includes a metallic stretcher 260 having a forward end 262 and a rearward end 264. The metallic stretcher 260 includes many of the same components and attributes as described in U.S. patent application Ser. No. 15/630,607 (the "'607 Application") to Hawkins et al., filed Jun. 22, 2016, the disclosure of which is hereby incorporated by reference herein except for express definitions and patent claims contained therein. As explained '607 Application, the metallic seat stretcher 260 may be mounted to the seat box 232 with a single fastener at the forward end 262 and a single fastener at the rearward end 264.

Figure 23C:
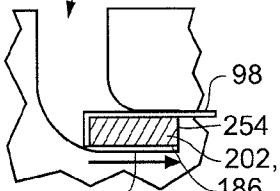
FIGS. 23A through 23C are schematic views depicting attachment of a rearward rail section of FIG. 20 to a rearward mounting bracket of FIG. 22 according to an embodiment of the disclosure.
Figure 23B:
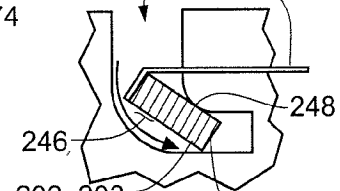
Figure 23A:
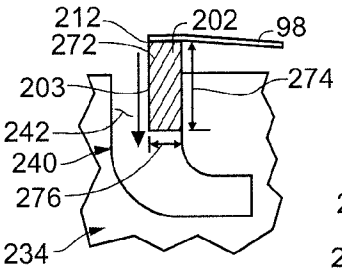

Referring to FIGS. 23A through 23C, mounting of a given rearward rail segment 202 into the rearward mounting bracket 234 is depicted according to an embodiment of the disclosure. The rearward rail segment 202 is depicted in a cross-section 272 having a length 274 and a thickness 276. The illustrated procedure of FIGS. 23A-23C assumes the straps 98 have been affixed to the rearward edge 212 of the rearward rail segment 202, for example as depicted in FIGS. 21A and 21B, and that the forward edge 92 of the platform portion 90 of the textile deck assembly 36 is anchored to the forward rail 82, as depicted, for example, at FIG. 14.

The end portions 203 of a given rearward rail segment 202 is oriented so that the length 274 of the cross-section 272 is substantially vertical and aligned over the vertical portion 242 of the mounting notch 240, with the rearward edge 212 of the rearward rail segment 202 with attached straps 98 are at the top of the cross-section 272 (FIG. 23A). The rearward rail segment 202 is then inserted into the vertical portion 242 of the mounting notch 240. In some embodiments, the seat deck assembly 36 is dimensioned so that the straps 98 must be pulled taut to insert the rearward rail segment 202 inserted into the vertical portion 242. The end portions 203 of the rearward rail segment 202 are then pushed downward to enter the transition portion 246 (FIG. 23B). While being pushed through the transition portion 246, the rearward rail segment 202 is rotated about the arcuate surface 248. In the depicted embodiment, this action causes further elongation of the straps 98. The end portions 203 of the rearward rail segment 202 then enter the horizontal portion 244 of the mounting notch 240, so that the forward edge 186 of the rearward rail segment 202 registers against the abutment 254 (FIG. 23C). The dimensions and locations of the various components of the seat deck assembly 36 and seat frame assembly 232 (e.g., the length of the straps 98, the length 274 of the rearward rail segment 202, and position of the abutment 254) may be arranged to effect the installation tension forces described attendant to FIGS. 16 and 17 for each strap 98.

Figure 24:
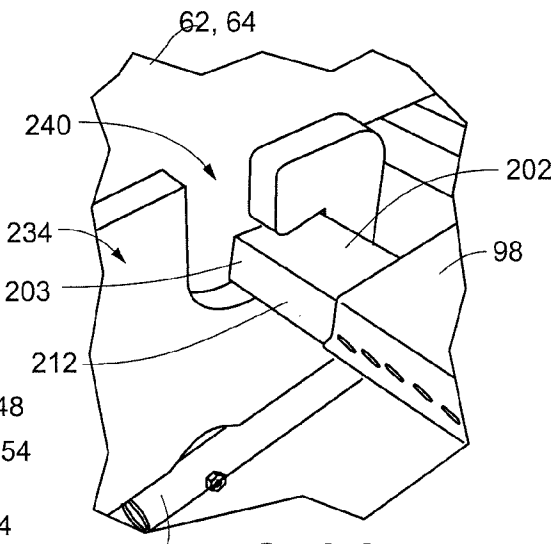
FIGS. 24 and 25 are perspective views of a rearward rail section of FIG. 20 secured within the rearward mounting brackets of FIG. 21 according to an embodiment of the disclosure.

The results of the mounting of the rearward rail segment 202 to the rearward mounting brackets 234 is depicted in FIGS. 24 and 25. The rearward rail segment 202 is drawn into a biased registration against the abutment 254, the biasing being provided by the straps 98 being in tension. In some embodiments, the horizontal portion 244 of the mounting notch 240 is dimensioned to provide a snug fit with the thickness 276 of the cross-section 272, to prevent movement and attendant rattling of the segmented rearward rail 201 in service. It is further noted that the straps 98 extend rearward of the lower backrest rail 72 in the embodiment of FIGS. 22 through 25, as well as in the embodiment of FIG. 26, an aspect that can also be incorporated into the embodiment of FIGS. 1 through 3.

Functionally, the width dimension 256 of the vertical portion 242 being greater than the height dimension 258 of the horizontal portion 244 enables the rearward rail segment 202 to turn the corner through the transition portion 246, while maintaining the narrower height dimension 258 for closer fit of the rearward rail segment 202 within the horizontal portion 244. The arcuate surface 248, when implemented, provides for smoother passage of the rearward rail segment 202 through the transition portion 246. By disposing the straps 98 behind the lower backrest rail 72, the straps 98 behind the at least one cushion 38, free of rubbing contact therewith that can cause wear on the cushions and also cause the cushions to creep forward.

Figure 26:
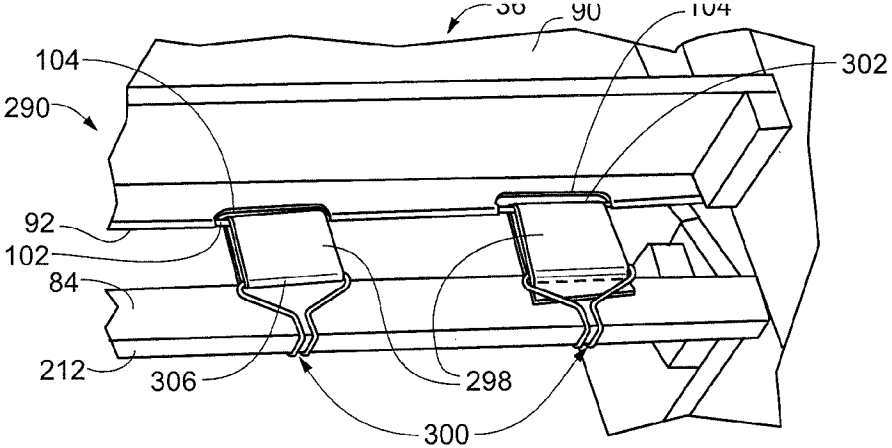
FIG. 26 is a perspective view of a textile deck assembly with strap clips that mount to a rearward rail of a seat frame assembly according to an embodiment of the disclosure.

Referring to FIG. 26, a mounting configuration 290 that utilizes strap clips 300 is depicted according to an embodiment of the disclosure. The strap clips 300 are coupled to straps 298, and hooked about the rearward edge 212 of the rearward rail 84 to draw the straps 298 tight and maintain said textile deck assembly 36 in tension. In some embodiments, the straps 298 form a closed loop that loops about the yoke member 102 at a forward end 302 of the strap 298, and loops about a cross portion 304 of the strap clip 300 at a rearward end 306.

Figure 28A:
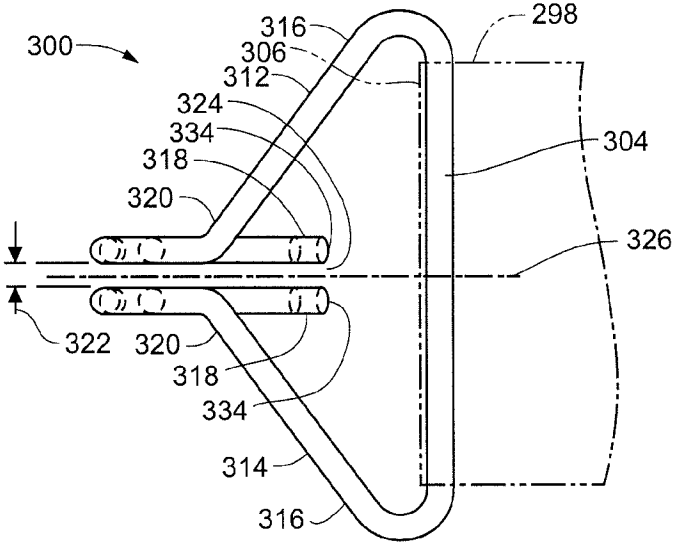
FIG. 28A is a plan view of the strap clip of FIG. 27.
Figure 28B:
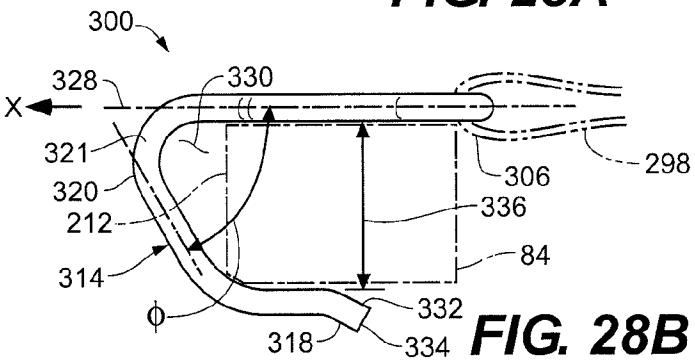
FIG. 28B is a side elevational view of the strap clip of FIG. 27.
Figure 27:
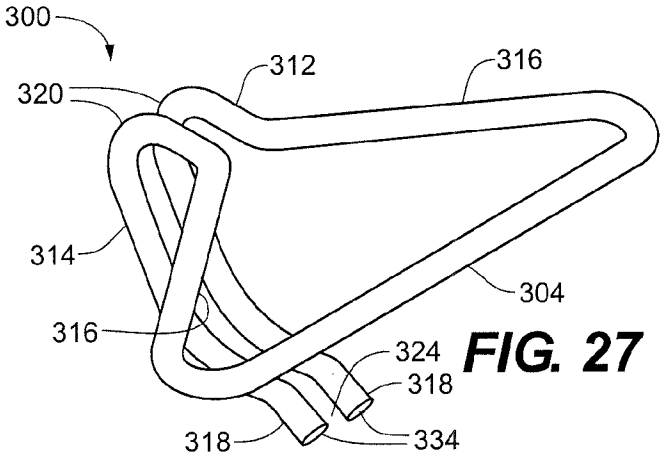
FIG. 27 is a perspective view of a strap clip of FIG. 26 in isolation according to an embodiment of the disclosure.

Referring to FIGS. 27, 28A, and 28B, the strap clip 300 is depicted in isolation according to an embodiment of the disclosure, with the rearward rail 84 and the rearward end 306 of the strap 298 being depicted in phantom. Each strap clip 300 includes the cross portion 304 supported by a first and second hook portions 312 and 314 that extend from opposing ends of the cross portion 304. Each of the hook portions 312, 314 may include a proximal end 316 attached to the cross portion 304 and a free distal end 318, the proximal and distal ends 316 and 318 being connected by a middle portion 320 that includes an apex portion 321 that transitions to the distal ends 318. The first hook portion 312 and the second hook portion 314 cooperate to define a gap 322 therebetween. In one embodiment, the gap 322 defines an opening 324 between the free distal ends 318, the gap 322 extending the length of the hook portions 312, 314 to the cross portion 304. The gap 322 may be of varying width, with a minimum dimension defined between the distal ends 318 or between the middle portions 320 generally. Also, in the depicted embodiment, the first of the pair of hook portions 312 and said second of the pair of hook portions 314 are a mirrored about a central plane 326 that is orthogonal to the cross portion 304. In the depicted embodiment, the gap 322 is bridged only by the cross portion 304.

In some embodiments, the proximal ends 316 of the hook portions 312, 314 and the cross portion 304 define a plane 328 that is perpendicular to the central plane 326 and, in assembly, lies substantially parallel to the fore-and-aft direction (i.e., substantially parallel to the x-axis of the Cartesian coordinate 89 of FIG. 1). The middle portion 320 may be canted relative to the plane 328 so that the apex portion 321 defines an acute angle $\phi$ therebetween (FIG. 28B). The distal end portions 318 may include a lead-in structure 332 at a distal extremity 334 of the distal end portion 318. In the depicted embodiment, a vertical clamping dimension 336 is defined between the proximal end portion 316 and the distal end portion 318.

Functionally, the gap 322 and opening 324 enables the strap clip 300 to be coupled to a strap 298 that is pre-formed to define a closed loop. The strap clip 300 can be manipulated so that the opening 324 and gap 322 is slid laterally over the rearward end 306 of the closed loop strap 298, then rotated into place with the cross portion 304 extending along the rearward end 306 of the closed loop strap 298. In some embodiments, the hook portions 312, 314 cooperate with the rearward rail 84 to define a clearance 330 between the rearward edge 212 of the rearward rail 84 and the 328 and the apex portion 321. The canted middle portion 320 also provides an additional spring loading of the closed loop strap 298 that may make up for length differences between the closed loop straps 298 and provide better compliance of the strap clip 300 in assembly. The lead-in structure 332 may assist installation personnel in placement of the strap clips 300, and enable the vertical clamping dimension 336 to be dimensioned for a tight fit over the rearward rail 84 without hindering the installation of the strap clips 300.

Figure 29A:
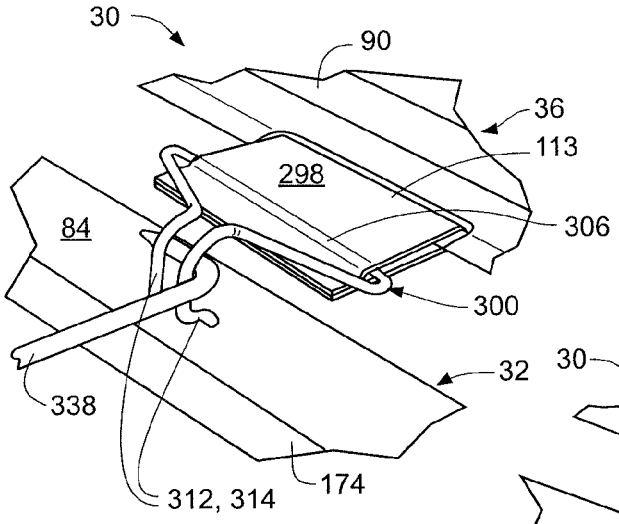
Figure 29B:
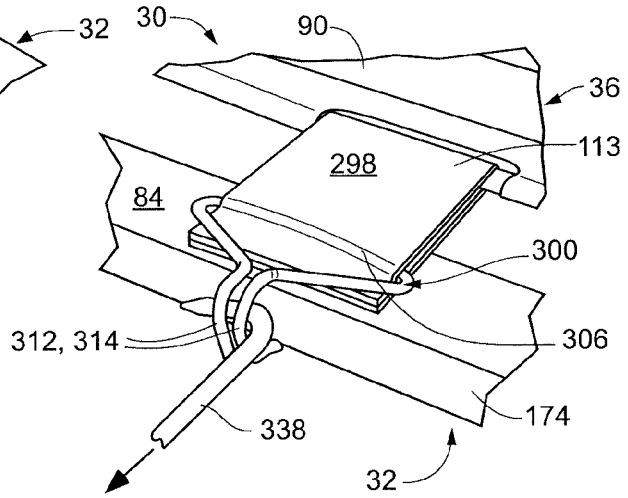
Figure 29C:
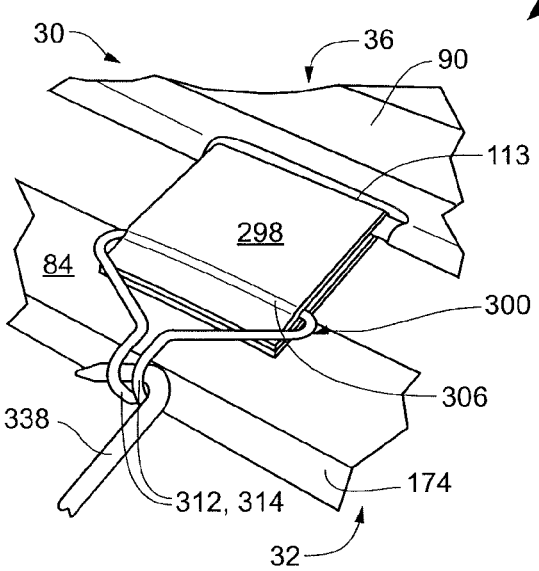

Referring to FIGS. 29A-29D, a method for mounting the textile seat deck assembly 36 to the seat frame assembly 32 is depicted according to an embodiment of the disclosure. The method includes gripping a given strap clip 300 that is coupled to the rearward end 306 of the corresponding closed loop strap 298, the closed loop strap 298 with the forward end 113 that is coupled to the platform portion 90, the platform portion 90 being attached to the seat frame assembly 32. The strap clip 300 may then be pulled rearwardly from a first location over the rearward rail 84 (FIG. 29A) to a second location where at least the hook portion 312, 314 of the strap clip 300 is pulled past the rearward face 174 of the rail (FIG. 29B). By pulling the strap clip 300 from the first location to the second location, a tension applied to the closed loop strap 298 and the platform portion 90 is increased. The hook portion 312, 314 of the strap clip 300 is aligned with the rail 300 (FIG. 29C) so that releasing the pulling of the strap clip 300 will cause the hook portion 312, 314 to clip on to the rearward rail 84. The strap clip 300 is released when aligned with the rearward rail 84, the strap clip 300 being secured to the rearward rail 84 by the tension force applied by the closed loop strap 298 and the platform portion 90.

Figure 29D:
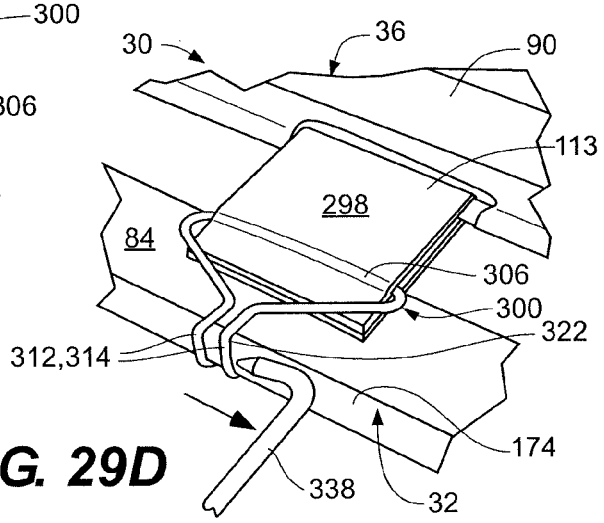

In some embodiments, the gripping of the strap clip 300 includes engaging a tool 338 with the hook portion(s) 312, 314 of the strap clip 300, wherein the pulling of the strap clip 300 is performed with the tool 338. In some embodiments, disengagement of the tool 338 from the strap clip 300 includes moving the tool 338 in a direction substantially parallel to the rearward face 174 of the rearward rail 84, thereby removing the tool 338 from the gap 322 defined between the hook portion 312, 314 and the rearward face 174 of the rearward rail 84 (FIG. 29D). The dimensions and locations of the various components of the seat deck assembly 36 and seat frame assembly 32 (e.g., the length of the closed loop straps 298 with strap clips, the spacing of the rearward face 174 and the yoke member(s) 102) may be arranged to effect the installation tension forces described attendant to FIGS. 16 and 17 for each closed loop strap 298.

Figure 30:
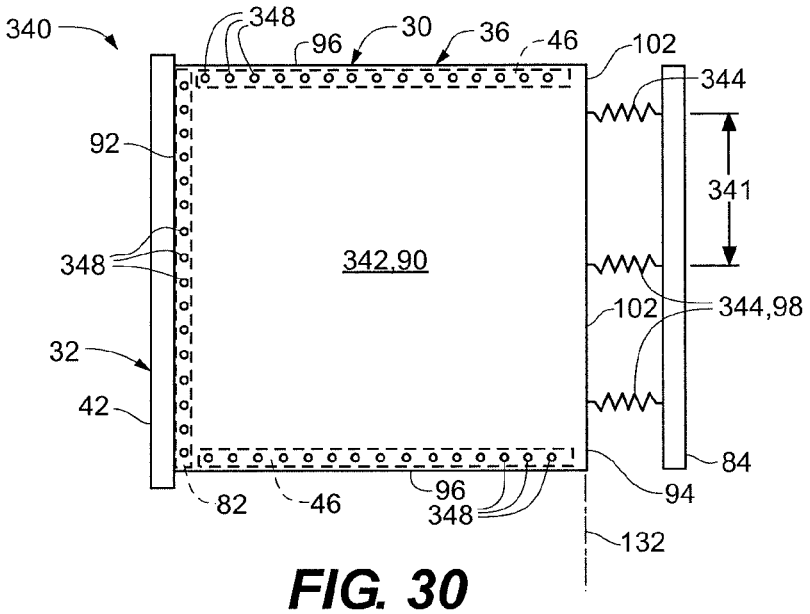
FIG. 30 is a schematic of the furniture assemblies according to embodiments of the disclosure.
Figure 30A:
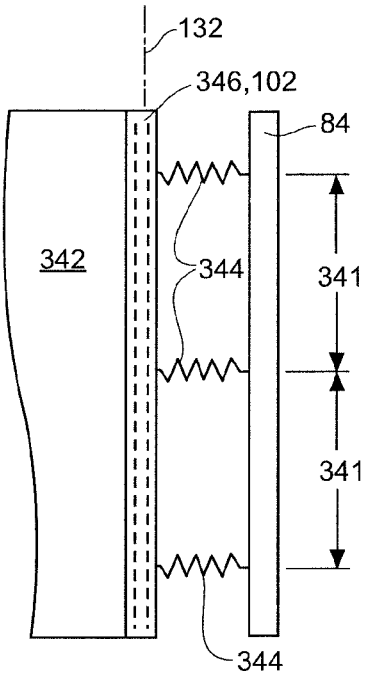
FIGS. 30A and 30B are schematic representations of alternative yoke arrangements according to embodiments of the disclosure.

Referring to FIG. 30, a generalized schematic 340 of the furniture assemblies 30 is presented according to embodiments of the disclosure. The schematic 340 is representative of the foregoing embodiments depicted herein. Specifically, the generalized schematic includes the deck assembly 36, the forward rail 82, the rearward rail 84, a flexible sheet platform portion 342 (e.g., the textile platform portion 90), the yoke member(s) 102, and a plurality of spring members 344 (e.g., the straps 98). The flexible sheet platform portion 342 includes the forward edge 92, the rearward edge 94, and opposing side edges 96 that extend between the forward edge 92 and the rearward edge 94. The plurality of spring members 344 extend rearward of the rearward edge 94 of the flexible sheet platform portion 342. The deck assembly 36 may be captured within the seat frame assembly 32, including the front wall 42 and two opposed side walls 46.

In the generalized schematic 340 of the depicted furniture assemblies 30, the forward edge 92 of the flexible sheet platform portion 342 is directly attached to the forward rail 82. In some embodiments, each of the opposing side edges 96 are directly attached to a respective one of the two opposed side walls 46 of the frame assembly 32. The rearward edge 94 of the flexible sheet platform portion 342 is coupled to the rearward rail 84 via the yoke member(s) 102 and the plurality of spring members 344, the plurality of spring members 344 extending rearward of the rearward edge 94. As described and depicted above, the yoke member(s) may be a rod, a bar, or a tubing. As described above, the forward edge 92 of the flexible sheet platform portion 342 is directly attached to the forward rail 82 with a plurality of fasteners 348, such as staples, nails, tacks, brads, or screws. In some embodiments, the fasteners 348 are spaced less than one inch apart along the forward edge 92.

The plurality of spring members 344 are spaced apart along the rearward edge 94 to define a center-to-center spacing 341 between adjacent ones of the plurality of spring members 344. The plurality of spring members 344 may be the elastic straps 98, or alternatively elastic cords or coil springs. In some embodiments, the center-to-center spacing 341 is in a range of 4 inches to 12 inches inclusive. Even though the spring members 344 apply tension forces at discrete points or intervals along the textile deck assembly 36, the yoke member(s) 102, 346 distribute the tension forces along the rearward edge 94, thus avoiding areas of increased stress concentrations and providing a substantially uniform firmness throughout the flexible sheet platform portion 342 or textile platform portion 90.

Figure 30B:
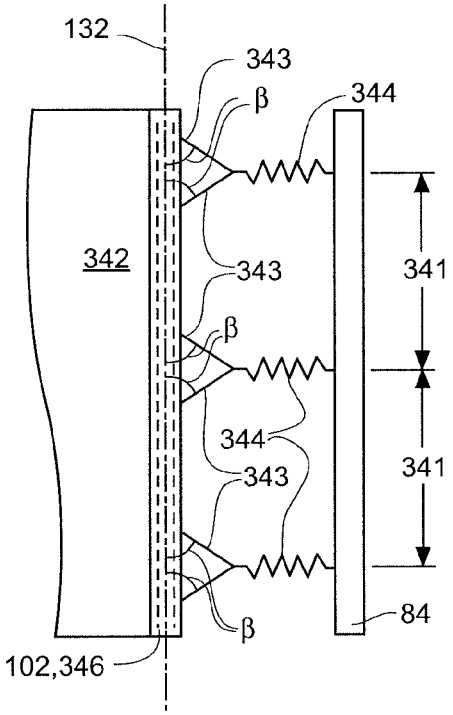

Referring to FIGS. 30A and 30B, alternative yoke arrangements are depicted. As described above and depicted in FIG. 30A, the yoke member(s) 102 may be a rope or a strap 346 affixed directly to the rearward edge 94 of the flexible sheet platform portion 342, for example by a sewing or riveting. The rope or strap 346 may thick in the vertical direction and wide in the fore-and-aft direction. For FIG. 30B, the spring members 344 may be connected to the yoke member(s) 102 via angled tie members 343 that define acute angles β with respect to the yoke axis 132.

Functionally, the yoke member acts to distribute tension loads imparted by the plurality of spring members 344 along the rearward edge 94 of the flexible sheet platform portion. The angled tie members 343 of adjacent spring members 344 act to oppose each other along the rearward edge 94 to maintain the strap or rope yoke member 102 in tension, to prevent or limit folding or distortion of the yoke member(s) 102. Providing rope or straps 346 of substantial thickness and width functions to spread the tension load over the rearward edge 94 of the flexible sheet platform portion 342 or textile platform portion 90.

Performance Testing

A series of tests were performed on a conventional sofa utilizing sinuous springs and on a test furniture assembly 30*a* (sofa) utilizing a test seat frame assembly 32*a* in accordance with embodiments of the disclosure. The test seat frame assembly 32*a* of the test furniture assembly 30*a* utilized test straps 98 folded once over the yoke members 102, having a nominal width (lateral dimension in FIG. 1) ranging from 48 mm to 50 mm in width inclusive, and having a interwoven composition of polypropylene (PP) flat yarn with a linear mass density of 1000 denier (D), PP multifilament yarn of 1200D, and 24 gauge bare rubber thread. The straps 98 were installed at a tension of nominally 51 lbf.

The results of various tests are presented and compared below to see how the test furniture assembly 30*a* with the test seat frame assembly 32*a* performs relative to the sofa having conventional decking with sinuous springs.

1. Deflection Testing Prior to Fatigue Testing

Referring to FIG. 30, a deflection test on the test furniture assembly 30*a* is depicted while in progress. The deflection test utilized a weight stack 350 situated on a weight stand 352, the weight stand 352 including legs 354 that hook over the front of the cushion 38, the stand being centered on a cushion of the test furniture assembly 30*a*. The deflection test was performed at each of the cushions of the test furniture assembly 30*a*. The deflection test was also repeated at each cushion of the conventional sofa, also prior to fatigue testing.

For the deflection test reported herein, the platform of the weight stand 352 weighed approximately 40 lbf and the weight stack 350 weighed approximately 150 lbf, for a total of approximately 190 lbf. It is estimated that a person sitting on a sofa exerts about 70% of his or her weight on a seat box of a sofa, with about 20% being transferred to a back rest and about 10% transferred directly to the ground through the person's feet. Based on the 70% transferred to the seat box, the 190 lbf exerted by the weight stand 352 and weight stack 350 simulates the weight of an occupant weighing approximately 270 lbf.

While under the test load, the textile deck assembly 36 of the test furniture assembly 30*a* deflected downward 63 mm on average. The downward deflection of the conventional sofa was comparable but greater, at 66 mm.

2. Fatigue Testing

Figure 31:
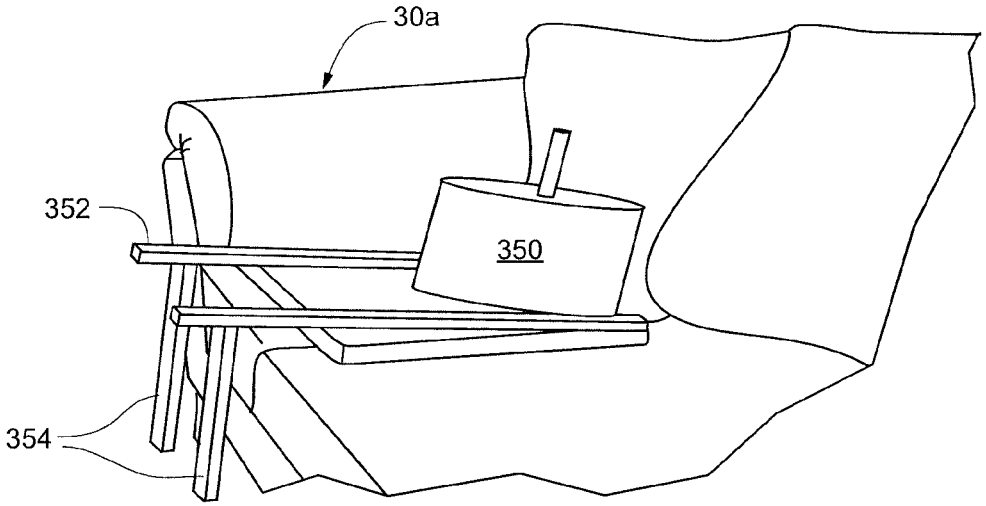
FIG. 31 is a partial perspective view of a test furniture assembly according to an embodiment of the disclosure during a deflection test.

Referring to FIG. 31, fatigue testing on the test furniture assembly 30*a* is depicted while in progress. The fatigue testing is based on the protocol outlined in the FNAE 80-214 and FNAE 80-214A testing standards, promulgated by the General Services Administration (GSA) of the United States government (available at https://www.extension.purdue.edu/extmedia/fnr/fnr-176.pdf and http://www.gsa.gov/portal/mediald/215763/fileName/Upholstered Furniture Test Method.action, respectively, last visited on Oct. 17, 2016), the disclosures of which are incorporated by reference herein except for express definitions contained therein. The test furniture assembly 30*a* was subject to a simulation of 20,000 weight application cycles that alternated between a simulated weight of effectively zero and about 225 lbf per cycle on each cushion. As illustrated in FIG. 31, the fatigue testing was performed on all three cushions 38*a*, 38*b*, and 38*c* of the test furniture assembly 30*a*. The same fatigue testing was performed on the conventional sofa.

The no-load elevations of the textile deck assembly 36 of the test furniture assembly 30*a* and the crown of the conventional sofa were measured after the fatigue testing and compared with pre-fatigue testing values to determine the permanent sag induced by the fatigue testing. The average permanent sag induced by the fatigue testing for the test furniture assembly 30*a* and the conventional sofa were comparable—3 mm and 2 mm, respectively.

3. Deflection Testing After Fatigue Testing

After the fatigue testing, the deflection test described above was repeated on both the test furniture assembly 30*a* and the conventional sofa. On average, the test furniture assembly 30*a* deflected downward 67 mm, or 4 mm more than for the pre-fatigue testing deflection. The conventional sofa averaged a downward deflection of 78 mm, of 8 mm more than for the pre-fatigue testing.

4. Drop Testing

Figure 32:
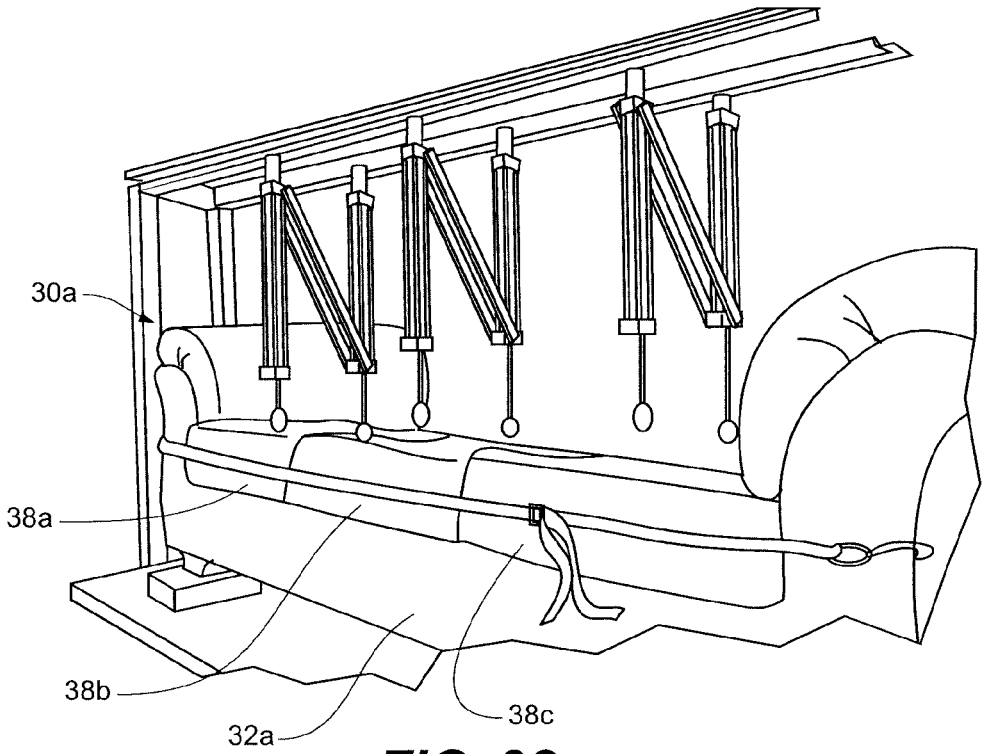
FIG. 32 is a partial perspective view of the test furniture assembly of FIG. 31 during a fatigue test.
Figure 33:
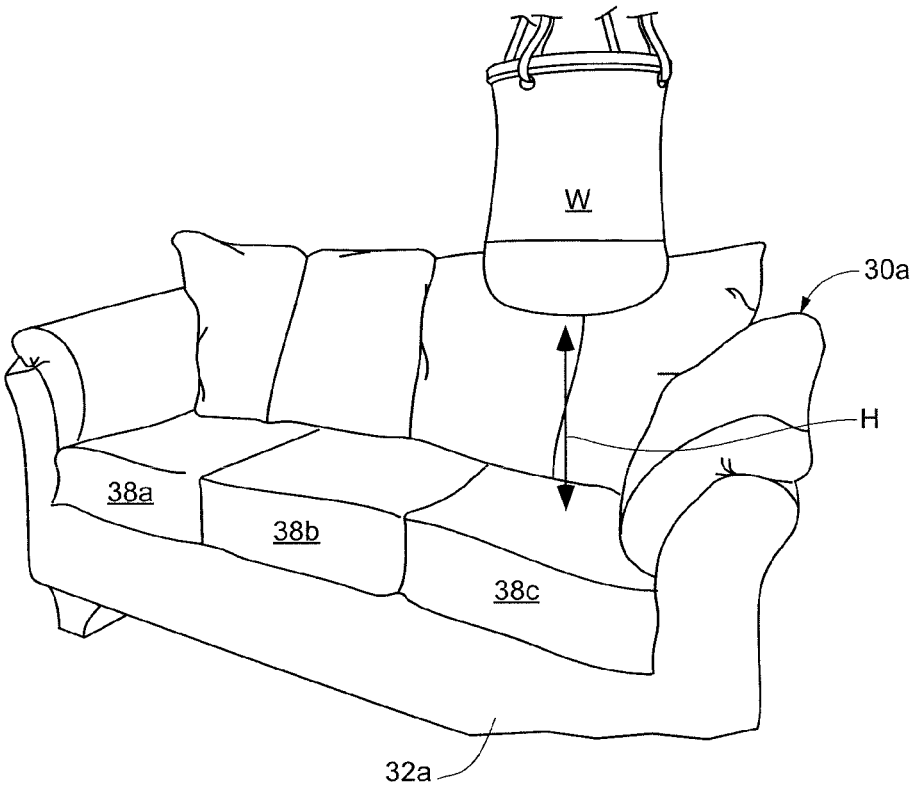
FIG. 33 is a partial perspective view of the test furniture assembly of FIG. 31 during a drop test.

Referring to FIG. 32, the test furniture assembly 30*a* is depicted a drop test. The drop testing is based on the protocol outlined in the ANSI/BIFMA X5.4-2005 testing standards, promulgated by the Business Institutional Furniture Manufacturers Association (BIFMA), the disclosure of which is incorporated by reference herein except for express definitions contained therein. The drop test procedure for the drop test is to drop a sand bag having a weight W onto the each of the cushions in succession of the furniture item under test, from a height H above the cushion. For the initial drop tests, the sand bag was trimmed for a weight W of 200 lbf, and was dropped 10 times on each cushion 38*a*, 38*b*, and 38*c* from a height H of 6 inches.

The no-load elevations of the textile deck assembly 36 of the test furniture assembly 30*a* and the crown of the conventional sofa were measured after the drop test and compared with pre-drop test values to determine the permanent sag induced by the drop testing. The average permanent sag induced by the drop testing for the test furniture assembly 30*a* was 4 mm. The average permanent sag induced by the drop testing for the conventional sofa was 18 mm more than four times greater than the permanent sag experienced by the test furniture assembly 30*a*. That is, after the drop testing described, the permanent sag of the test furniture 30*a* was less than ¼ of the permanent sag of the conventional sofa.

5. Deflection Testing After Fatigue and Drop Testing

After the fatigue test and the drop test, the deflection test described above was repeated on both the test furniture assembly 30*a* and the conventional sofa. On average, the test furniture assembly 30*a* deflected downward 72 mm, or 9 mm more than for the pre-drop and pre-fatigue testing deflection. The conventional sofa averaged a downward deflection of 94 mm, or 28 mm more than for the pre-drop and pre-fatigue testing. That is, the downward deflection of the test furniture assembly 30*a* was less than ⅓ of the conventional sofa after the fatigue and drop testing.

6. Failure Testing

After completion of the tests above, additional drop tests on the test furniture assembly 30*a*, with the intention of causing structural failure. Additional drops of the weight W of 200 lbf weight were made on each of the three cushions 38*a*, 38*b*, and 38*c* from: the height H of six inches (five times); a height H of nine inches (five times); and a height H of 15 inches (10 times). The test seat frame assembly 32*a* remained intact through the additional drop test at the weight W of 200 lbf. Thereafter, 50 lbf of weight was added to the sand bag for a total weight W of 250 lbf and dropped 10 times from the 15 inch height on the left facing cushion 38*a*. Again, the test seat frame assembly 32*a* remained intact. The 250 lbf sand bag was then dropped three times from the 15 inch height onto the center cushion 38*b*. During the third drop, the back wall 44 of the seat frame assembly 32 was broken in two. The textile deck assembly 36 remained intact.

Based on previous testing, it is known that the conventional sofa decking utilizing the sinuous springs would experience 100% failure before or during the 200 lbf drop test from the nine inch height. Accordingly, the durability of the test furniture assembly 30*a* substantially exceeded both expectations and that of the conventional sofa.

While the disclosure is amenable to various modifications and alternative forms, specifics thereof have been shown by way of example in the drawings and described in detail. It is understood, however, that the intention is not to limit the application to the particular embodiments described. On the contrary, the intention is to cover all modifications, equivalents, and alternatives falling within the spirit and scope of the disclosure as defined by the appended claims.

Persons of ordinary skill in the relevant arts will recognize that various embodiments can comprise fewer features than illustrated in any individual embodiment described above.

The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

References to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A sofa comprising a wood sofa frame, the wood sofa frame having a seat frame and a back frame, a textile deck assembly attached to the seat frame, upholstery attached to the frame, and seat cushions on the seat frame;

the seat frame comprising a wood forward rail, a wood rearward rail, and a pair of wood side frame members;

the textile deck assembly comprising a flexible and elastic sheet platform portion formed of a textile and having a forward edge, a rearward edge, and opposing side edges that extend between the forward edge and the rearward edge, the flexible and elastic sheet platform portion at the forward edge overlaying and attached to the wood forward rail with a plurality of fasteners, the flexible and elastic sheet platform portion at each of the opposing side edges overlaying and attached to respective wood side frame members with a plurality of fasteners, and wherein the rearward edge of the flexible and elastic sheet platform portion is positioned forwardly of the rearward rail and having a plurality of platform loops that capture at lease one rigid yoke member extending through the plurality of platform loops, the textile deck assembly further comprising a plurality of straps each having a strap loop with each strap loop enclosing the rigid yoke member such that the plurality of platform loops and the strap loops of the plurality of straps alternate along the rigid yoke member, each of the straps overlaying and attached to the rearward rail, each of the plurality of straps being under tension and the center to center spacing of adjacent straps is 4 to 12 inches inclusively.

2. The sofa of claim 1, wherein the each of the plurality of straps is an elastic strap and having a length with an end extending past an upward face or the rearward rail and downward past a rearward face of the rearward rail, each of the plurality of straps attached with a plurality of fasteners to the rearward rail.

3. The sofa of claim 2, wherein each of the plurality of straps has an aperture at an end opposite the strap loop for use in attachment of each respective strap to the rear rail of the sofa frame.

4. The sofa of claim 1, wherein the textile deck assembly further comprises a plurality of upholstery panels connecting to one or more of the opposing side edges and the rearward edge.

5. The sofa of claim 1, wherein the sofa is configured as an assembled ready-to-assemble sofa with two sofa frames and two textile deck assemblies connected together.

6. The sofa of claim 1 comprising a plurality of yoke members along the rearward edge of the flexible and elastic sheet platform portion, the yoke member in linear alignment.

7. The sofa of claim 1, wherein the forward edge of the flexible and elastic sheet platform portion has a plurality of fastening strips, one fastening strip corresponding for each yoke member of the plurality of yoke members thereby defining fold lines.

8. A sofa seat platform kit for attachment to a sofa frame, the sofa frame having a wood seat frame and a wood back frame, the seat frame comprising a wood forward rail, a wood rearward rail, and a pair of wood side frame members, the sofa seat platform kit comprising: a textile deck comprising a flexible sheet platform portion having a forward edge, a rearward edge, and opposing side edges that extend between the forward edge and the rearward edge, the forward edge including one or more fastening strips for direct attachment to the forward rail, each of the opposing side edges being directly attachable to the respective wood side frame members, the rearward edge of the flexible sheet platform portion having a plurality of platform loops for one or more rigid yoke members, one or more rigid yoke members, a plurality of straps, each strap having an end with a strap loop for attachment to one of the rigid yoke members such that the plurality of platform loops and plurality of straps alternate along the plurality of rigid yoke members when installed on the sofa frame, each strap sized to extend between one of the rigid yoke members and the rearward rail when the platform kit is installed on the sofa frame, and each strap having an end opposite the strap loop with an aperture for receiving an attachment tool for attaching each respective strap to the rearward rail, the flexible sheet platform portion folded.

9. The sofa seat platform kit of claim 8, in combination with the sofa frame.

10. The sofa seat platform kit of claim 8, further comprising a plurality of upholstery panels attached to the platform portion at the forward or the two side edges.

11. The sofa seat platform kit of claim 8, comprising at least one guide strip along the forward edge for attachment of fasteners.

12. The sofa seat platform kit of claim 8, comprising a plurality of yoke members, and wherein the forward edge of the platform portion a corresponding plurality of guide strips, and wherein the plurality of guide strips define fold lines of the seat platform portion.

13. A method of installing the sofa seat platform kit of claim 8 on the sofa frame, the method comprising:

affixing said forward edge of said flexible sheet platform portion to a forward rail of said seat frame assembly;

attaching each of the opposing side edges to the pair of wood side frame members with staples;

if not already installed, installing the yoke member in the plurality of platform loops and in the loops of each of the straps;

affixing each of the plurality of straps to the rearward rail by inserting a shaft through each one of said plurality of straps, placing said shaft against a rearward face of said rearward rail; and rotating said shaft in a rearward direction to stretch textile deck assembly toward the rearward rail, and fastening each one of said plurality of straps with staples to the rearward rail.

14. A sofa comprising a wood sofa frame, the wood sofa frame having a seat frame and a back frame, a deck assembly attached to the seat frame, upholstery attached to the frame, and seat cushions on the seat frame; the seat frame comprising a wood forward rail, a wood rearward rail, and a pair of wood side frame members extending between the forward rail and the rearward rail; the deck assembly comprising a continuous flexible and elastic sheet platform portion having a forward edge, a rearward edge, and opposing side edges that extend between the forward edge and the rearward edge, the platform portion at the forward edge overlaying and attached to the wood forward rail with a plurality of fasteners, the platform portion at each of the opposing side edges overlaying and attached to respective wood side frame members with a plurality of fasteners, and wherein the rearward edge of the continuous flexible and elastic sheet platform portion is positioned forwardly of the rearward rail and having a plurality of platform loops that capture at least one rigid yoke member extending through the plurality of platform loops, the deck assembly further comprising a plurality of straps each having a strap loop with each strap loop on the rigid yoke member such that the plurality of platform loops and the strap loops of the plurality of straps alternate along the rigid yoke member, each of the straps overlaying and attached to the rearward rail, each of the plurality of straps being elastic and being under tension.

15. The sofa of claim 1, wherein and wherein the center to center spacing of adjacent straps is 4 to 12 inches inclusively and each of the straps overlays a top surface and a rearward surface of the rearward rail.

16. The sofa of claim 1, wherein the platform portion is formed of an elastic textile.

17. The sofa of claim 1, wherein the textile deck assembly further comprises a plurality of upholstery panels connecting to one or more of the opposing side edges and the rearward edge.

18. The sofa of claim 1, wherein each of the plurality of straps having a length extending past a rearward face of the rearward rail, each of the plurality of straps attached with a plurality of fasteners to the rearward rail.

19. The sofa of claim 1, wherein each of the straps are fastened by way of a plurality of staples in the top face of the rearward rail and the rearward face of the rearward rail.

20. The sofa of claim 1, wherein the sofa is configured as an assembled ready-to-assemble sofa with two sofa frames and two deck assemblies.

* * * * *